US007980181B2

(12) United States Patent
Heaslip et al.

(10) Patent No.: US 7,980,181 B2
(45) Date of Patent: Jul. 19, 2011

(54) DRAG RACING ROLLER COASTER AMUSEMENT RIDE AND LAUNCH SYSTEM

(75) Inventors: Christopher James Heaslip, Invercargill (NZ); Robert Cummins, Wellington (NZ)

(73) Assignee: Manchester Securities Limited, Days Bay, Eastbourne, Wellington (NZ)

( * ) Notice: Subject to any disclaimer, the term of this patent is extended or adjusted under 35 U.S.C. 154(b) by 360 days.

(21) Appl. No.: 11/994,906

(22) PCT Filed: Jul. 6, 2006

(86) PCT No.: PCT/NZ2006/000174
§ 371 (c)(1),
(2), (4) Date: Aug. 13, 2008

(87) PCT Pub. No.: WO2007/004904
PCT Pub. Date: Jan. 11, 2007

(65) Prior Publication Data

US 2009/0031913 A1 Feb. 5, 2009

(30) Foreign Application Priority Data

Jul. 6, 2005 (NZ) ..... 541121

(51) Int. Cl.
*A63G 1/00* (2006.01)

(52) U.S. Cl. ..... 104/63; 104/60; 104/53

(58) Field of Classification Search ..... 104/53–63
See application file for complete search history.

(56) References Cited

U.S. PATENT DOCUMENTS

| | | | | | |
|---|---|---|---|---|---|
| 4,165,695 | A | * | 8/1979 | Schwarzkopf | 104/55 |
| 4,991,514 | A | * | 2/1991 | Powell et al. | 104/60 |
| 5,272,984 | A | * | 12/1993 | Bolliger et al. | 104/63 |
| 5,522,321 | A | * | 6/1996 | Mosley et al. | 104/60 |
| 5,595,121 | A | * | 1/1997 | Elliott et al. | 104/53 |
| 5,967,051 | A | | 10/1999 | Ragsdale et al. | |

(Continued)

FOREIGN PATENT DOCUMENTS

JP 9117570 5/1997

(Continued)

OTHER PUBLICATIONS

"The one-stop adrenaline park", Park World Magazine.

*Primary Examiner* — S. Joseph Morano
*Assistant Examiner* — Jason C Smith
(74) *Attorney, Agent, or Firm* — Dann, Dorfman, Herrell and Skillman, P.C.

(57) ABSTRACT

A drag racing roller coaster amusement ride has at least two sets running rails, each set having at least one running rail and an embark point. At least two carriers (109) are arranged to carry at least one rider on a respective set of running rails with the rider(s) in a substantially prone position. Each carrier is arranged to slidingly engage with the respective set of running rails to enable the carriers to traverse the ride. The ride has an indicator (109) to provide a ride commencement indication. A launch system is configured to provide a powered initial motion to each carrier. Each carrier has a ride activator controllable by a rider of the carrier to trigger the launch system to commence the ride for the carrier following the ride commencement indication. Launch systems are also disclosed.

56 Claims, 19 Drawing Sheets

U.S. PATENT DOCUMENTS

| | | | | |
|---|---|---|---|---|
| 5,979,333 | A * | 11/1999 | Houben et al. | 104/63 |
| 6,047,645 | A * | 4/2000 | Cornwell et al. | 104/124 |
| 6,155,176 | A * | 12/2000 | Checketts | 104/53 |
| 6,176,788 | B1 * | 1/2001 | Checketts | 472/43 |
| 6,269,750 | B1 * | 8/2001 | Cornwell et al. | 104/53 |
| 6,402,624 | B1 * | 6/2002 | Larson et al. | 472/44 |
| 6,405,655 | B1 * | 6/2002 | Clerx et al. | 104/63 |
| 6,439,129 | B2 * | 8/2002 | Begotti | 104/63 |
| 6,513,441 | B1 * | 2/2003 | Clerx et al. | 104/53 |
| 6,523,479 | B1 * | 2/2003 | Schilke et al. | 104/57 |
| 6,592,462 | B2 * | 7/2003 | Puch | 472/43 |
| 6,606,953 | B2 * | 8/2003 | Mares | 104/76 |
| 6,679,182 | B2 * | 1/2004 | Spieldiener et al. | 104/53 |
| 6,746,335 | B2 * | 6/2004 | Kleimeyer et al. | 472/131 |
| 6,837,166 | B1 * | 1/2005 | Roodenburg et al. | 104/53 |
| 6,910,972 | B2 * | 6/2005 | Norbury | 472/85 |
| 7,192,010 | B2 * | 3/2007 | Roodenburg et al. | 254/360 |
| 7,640,862 | B2 * | 1/2010 | Zamperla | 104/53 |
| 2001/0023649 | A1 * | 9/2001 | Begotti | 104/63 |
| 2003/0140815 | A1 * | 7/2003 | Norbury | 104/53 |
| 2005/0274275 | A1 * | 12/2005 | Gordon | 104/53 |
| 2006/0178221 | A1 * | 8/2006 | Threlkel | 472/1 |
| 2007/0199474 | A1 * | 8/2007 | Zamperla | 104/53 |
| 2008/0143158 | A1 * | 6/2008 | Roodenburg et al. | 297/284.4 |
| 2009/0031913 | A1 * | 2/2009 | Heaslip et al. | 104/63 |

FOREIGN PATENT DOCUMENTS

| | | |
|---|---|---|
| NZ | 532277 | 4/2004 |
| WO | 9622821 | 8/1996 |
| WO | 0062882 | 10/2000 |
| WO | 02085478 | 10/2002 |
| WO | 2004035164 | 4/2004 |
| WO | 2005099847 | 10/2005 |

* cited by examiner

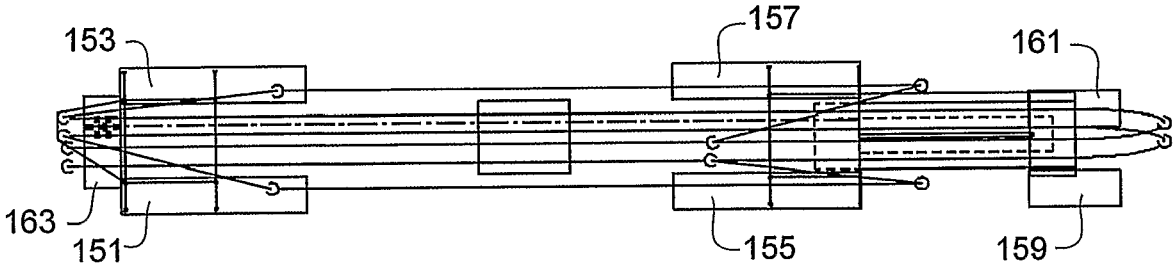
FIGURE 8B
FIGURE 8C
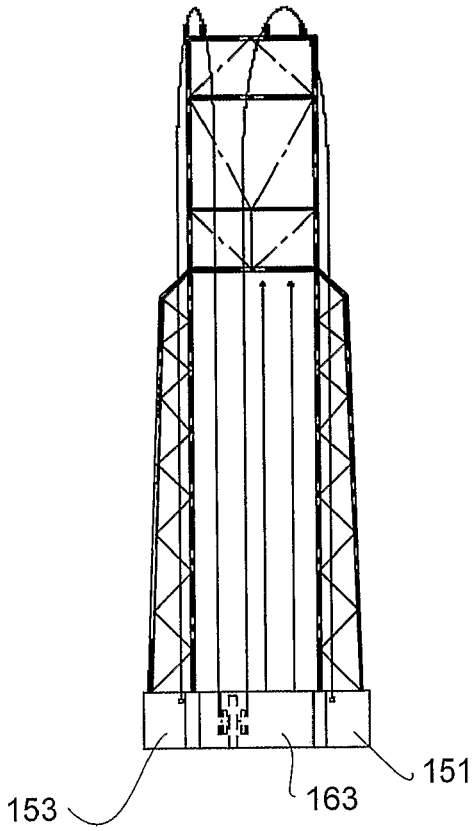

DRAG RACING ROLLER COASTER AMUSEMENT RIDE AND LAUNCH SYSTEM

FIELD OF INVENTION

The invention relates to an amusement ride. Additionally, the invention relates to a launch system for an amusement ride.

BACKGROUND

A number of amusement rides have been devised in which riders can apparently race each other in a simulated dragster format. Typically two tracks are provided side by side and a mocked up drag racer is provided on each track. The set up typically includes a set of "Christmas Tree" drag racing lights or other suitable indicator to indicate when to go. When the lights indicate go the riders can accelerate the vehicles by pressing on an accelerator whereupon the vehicles are propelled along the tracks by various means including linear induction motors, compressed air, hydraulic pressure, elastic cords or other means. The rider with the quicker reactions will gain an advantage in the simulated race. This type of independent start gives the riders the thrill of competition. While this type of ride provides riders an opportunity to apparently race each other, the riders typically race along a straight track on level ground.

Because the rides are also typically set up so as to resemble so far as is practicable the real drag race format, this has been seen to require mocked up dragster motor vehicles in which the riders are typically seated. These vehicles are typically weighty and bulky, and have rider restraint systems and tracks suitable only for ride on level ground.

Simulated dragster racing amusement rides of this type or similar include those disclosed by Powell (U.S. Pat. No. 4,991,514), Mosley (U.S. Pat. No. 5,522,321), Ragsdale (U.S. Pat. No. 5,967,051), Puch (U.S. Pat. No. 6,592,462), and Norbury (U.S. Pat. No. 6,910,972).

Another ride in which a rider controls the propulsion of a ride vehicle is described in U.S. Pat. No. 6,155,176. In this ride a modified snow mobile moves along a track between a start point and an end point. The rider controls propulsion of the vehicle which may be overridden by a controller. The track includes a friction braking system to slow the vehicle at the end of the ride.

A different form of ride is the traditional roller coaster where riders are strapped or otherwise held in seats in carriages that move along a track. A traditional roller coaster is typically permanently attached to the track. In these rides the start and end points of the ride are in the same place and some form of power, often a chain lift, is required to move the carriages into position to begin the ride. Alternatively the vehicles may be launched by means not dissimilar to the simulated dragster races or otherwise by means of a flywheel driven launch or a weight drop.

Launched forms of traditional roller coasters have been known since the 1970's when Anton Schwarzkopf of Germany, and others, engineered what became known as "Shuttle Loop" coasters which generally involved a straight track with a loop. The Schwarzkopf shuttle loop coasters were launched by a weight drop system. In the mid 1990's, Premier Rides Inc of Maryland built the first magnetic launch systems using linear induction motors. In 2001 S&S Power engineered a launch system using compressed gas (disclosed in U.S. Pat. No. 6,176,788 to Checketts) and in 2002 Intamin introduced a hydraulic launch system (disclosed in U.S. Pat. No. 6,679, 182 to Spieldiener). Other known roller coaster launch means include linear synchronous or AC or DC rotary electric motors.

These roller coasters are of a conventional configuration having a train of connected vehicles carrying a number of riders. A disadvantage of all these launched roller coasters is that there is no apparent race, riders have no control over the start of the launch, and the competitive element and additional thrill of the reaction time advantage and drag racing start is absent.

Roller coaster rides may also be themed so as to resemble drag racing vehicles. An example of this is the "Top Thrill Dragster" ride at Cedar Point Amusement Park, Ohio. This ride is set up to provide an illusion of a dragster with various sound effects and a high speed launch. However, there is only a single vehicle running on the ride at one time.

Roller coasters have been developed with riders seated in carriages above and below the rail. U.S. Pat. Nos. 6,269,750 and 6,047,645 and Japanese patent abstract JP 09-117570 show examples of this type of roller coaster. Like other roller coasters these systems form closed loop tracks. These types of rides do not allow the riders to control the start of the ride. Another disadvantage is that the riders are constrained within the carrier which limits the apparent danger of the ride. These rides also do not let individual riders apparently race each other down the track nor do they allow for riders to launch the ride in a competitive drag race manner.

U.S. Pat. No. 5,979,333 is an example of an amusement ride where the rider is in a prone position. A disadvantage of this type of ride is that it does not allow for two or more riders to traverse the same part of the track at different times. A further disadvantage is that riders have no control over the start of the ride.

Kleimeyer (U.S. Pat. No. 6,746,335) discloses a rapid winding winch which may be used for various amusement ride purposes including the launching of simulated drag racers or conventional roller coasters. The simulated drag race disclosed in that document uses relatively large mocked up cars, with riders in upright positions.

In this specification where reference has been made to patent specifications, other external documents, or other sources of information, this is generally for the purpose of providing a context for discussing the features of the invention. Unless specifically stated otherwise, reference to such external documents or such sources of information is not to be construed as an admission that such documents or such sources of information, in any jurisdiction, are prior art or form part of the common general knowledge in the art.

A roller coaster amusement ride is described in PCT application PCT/NZ03/00192 and New Zealand Patent 522068 which are incorporated herein by reference. Another roller coaster amusement ride is described in PCT application PCT/NZ2005/000074 and New Zealand Patent 532277 which are incorporated herein by reference.

It is the object of at least preferred embodiments of the present invention to provide an amusement ride that overcomes or alleviates one or more of the disadvantages described above, or to at least provide the public and/or those in the business of operating amusement rides with a useful choice. It is the object of at least alternative preferred embodiments of the present invention to provide a launch system for an amusement ride that at least provides the public and/or those in the business of operating amusement rides with a useful choice.

SUMMARY OF INVENTION

The term 'comprising' as used in this specification and claims means 'consisting at least in part of', that is to say when interpreting statements in this specification and claims which include that term, the features prefaced by that term in each statement all need to be present but other features can also be present. Related terms such as 'comprise', 'comprises', and 'comprised' are to be interpreted in a similar manner.

In accordance with a first aspect of the present invention, there is provided a drag racing roller coaster amusement ride comprising: at least two sets of independent running rails, wherein each set has at least one running rail and an embark point; at least two carriers each arranged to carry at least one rider on a respective set of running rails with the rider(s) in a substantially prone position, each carrier comprising at least one attachment mechanism arranged to slidingly engage with the respective set of running rails to enable the carriers to traverse the ride carrying the riders; an indicator arranged to provide a ride commencement indication; a launch system configured to provide a powered initial motion to each carrier; and a ride activator for each carrier controllable by a rider of the respective carrier to trigger the launch system to commence the ride for the respective carrier following the ride commencement indication; wherein the sets of running rails are arranged so that the carriers descend at least part of the ride, after the initial powered motion from the launch system, under gravity.

As used herein, "substantially prone position" shall mean a generally lying position in which the rider's body is generally aligned with the direction of travel of the carrier. The rider could be lying stomach up to travel feet or head first, or could be lying stomach down to travel feet or head first.

As least one of the sets of running rails may consist of a single rail. Alternatively, or in addition, at least one of the sets of running rails may consist of two rails. The number of running rails in each set may be different.

Each set of running rails may be part of a respective track, and the tracks may be independent from one another.

Suitably, forward motion of each carrier on the respective set of running rails is unpowered, other than by the launch system at the commencement of the ride. Alternatively, forward motion of each carrier on the respective set of running rails is powered for only part of the ride, other than at the commencement of the ride. In that embodiment, the carriers may be configured such that a rider can selectively apply the power at one or more sections of the ride.

The ride may comprise an anti-false start mechanism for each carrier that is configured to prevent a rider from launching the respective carrier prior to the ride commencement indication.

The ride may comprise a default start mechanism that is configured to launch the respective carrier after a predetermined period following the ride commencement indication if a rider fails to trigger the launch system.

Each carrier may be configured to support the rider(s) suspended below the respective set of running rails. Alternatively, each carrier may be configured to support the rider(s) above the respective set of running rails.

Each carrier may be configured to support the rider(s) either above or below the respective set of running rails.

Preferably, the indicator comprises or consists of a visual indicator. Alternatively, or in addition, the indicator may comprise or consist of an audible indicator.

In a preferred embodiment, the sets of running rails, although being of substantially the same length, are configured to diverge and then converge to create the impression of one carrier falling behind another and then catching up, and vice versa.

The sets of running rails are preferably configured with one or more of the group consisting of: twists, turns, barrel rolls, loops, and inversions.

Preferably, a carrier can be returned to an initial launch position without re-traversing any part of the set of running rails traversed during the ride. For that purpose, each set of running rails may be formed as a closed loop. Alternatively, each set of running rails may be formed as an open loop, and the carriers may be detachable from the respective set of running rails and re-attachable for a subsequent ride. In yet a further alternative, each set of running rails may formed as an open loop, but a portion of each set of running rails at or near an end of the ride may be moveable to carry the carrier to a portion of the set of running rails at or near the embark point.

Preferably, each set of running rails has a queuing region configured such that as one carrier is traversing a set of running rails, one or more carriers and riders can be queued ready for launch on that set of running rails.

Preferably, at least one of the carriers comprises a mechanism for at least one rider to apply a steering action to the carrier as it traverses the respective set of running rails, the mechanism adapted such that effective steering results in a mechanical advantage for the carrier by reducing friction between the carrier and the set of running rails as the carrier traverses regions of the respective set of running rails. Said at least one of the carriers may be sized and adapted to carry multiple riders, and the carrier may comprise a mechanism for each of the riders to apply a steering action to the carrier as it traverses regions of the respective set of running rails. Said mechanism may comprise a yoke, wheel, lever, joystick, or other means for the or each rider.

At least one of the carriers may be sized and adapted to carry a maximum of four riders, each in a substantially prone position. Said at least one of the carriers may have an unloaded weight of less than about 500 kg.

At least one of the carriers may be sized and adapted to carry a single rider. Said at least one of the carriers has an unloaded weight of less than about 300 kg.

At least one of the carriers may be adapted to carry a minimum of one rider and a maximum of two riders. Said at least one of the carriers may have an unloaded weight of less than about 450 kg.

The or each carrier adapted to carry multiple riders may have a plurality of interconnected carrier units, each adapted to carry a single rider.

Preferably, in an embodiment in which at least one of the carriers is sized and adapted to carry multiple riders, each of the riders of that carrier must activate a ride activator to trigger the launch system to commence the ride for that carrier.

At least one of the carriers may be configured such that at least one of the riders of that carrier straddles the respective set of running rails, to provide a low center of gravity for the rider(s).

Preferably, the launch system comprises a flywheel adapted to store energy, an energy source to rotate the flywheel, and two selective energy transfer mechanisms operatively connected to the flywheel, wherein each of the selective energy transfer mechanisms is operable, in response to actuation of a ride activator of a respective carrier, to independently transfer energy from the flywheel to the respective carrier to launch the respective carrier along the respective set of running rails.

At least one of the selective energy transfer mechanisms may comprise a mechanical clutch, an epicyclic gearbox, or a hydraulic motor for example.

Preferably at the embark point the at least two sets of running rails are positioned side by side.

The ride is set up so that the launch is competitive, in the manner of a drag race; the rider with the better reactions gains a head start advantage in the apparent race.

The ride may be arranged around a structure which may be a solid structure or may be supports forming a skeleton or shell of a structure or even poles. The structure may also be a natural feature such as a valley or canyon and the track may be situated in such a feature. Parts of the ride may be suspended and supported by cables or other means.

The word "rail" in the term "running rail" is not limiting on the shape of the running rail. Differing shapes and sizes of running rails may be provided within the invention. The sets of running rails may be identical. Alternatively the sets of running rails may be different. The running rails may converge onto a single track during a portion of the ride. In other embodiments each set of running rails may run substantially parallel to other sets of running rails of the ride or diverge and converge in a manner so as to increase the perception that one carrier is falling behind the other, and then catching up, in order to increase the excitement of the ride. It should be noted that the term "slidingly engage" is considered synonymous with the phrase "rotatably engage". That is, the engagement of each carrier with the respective set of running rails may be via rotatable members for example.

Each set of running rails allows a carrier or carriers to slidingly engage with the running rails without contacting carriers engaged to other running rails of the ride. This means that carriers slidingly engaged on different running rails may pass one another along the ride.

In accordance with a second aspect of the present invention, there is provided a drag racing roller coaster amusement ride, comprising: at least two sets of independent running rails, wherein each set has at least one running rail and an embark point; at least two carriers each arranged to carry at least one rider on a respective set of running rails, each carrier comprising at least one attachment mechanism arranged to slidingly engage with the respective set of running rails to enable the carriers to traverse the ride carrying the riders; an indicator arranged to provide a ride commencement indication; a launch system configured to provide a powered initial motion to each carrier; and a ride activator for each carrier controllable by a rider of the respective carrier to trigger the launch system to commence the ride for the respective carrier following the ride commencement indication; wherein the sets of running rails are configured such that a respective carrier can be returned to an initial launch position without re-traversing any part of the set of running rails traversed during the ride, and each set of running rails has a queuing region configured such that as one carrier is traversing a set of running rails, one or more carriers and riders can be queued ready for launch on that set of running rails.

Preferably, the sets of running rails are arranged so that the carriers descend at least part of the ride, after the initial powered motion from the launch system, under gravity.

This aspect may be used with carriers adapted to hold rider(s) in substantially prone position(s), or may be used with carriers adapted to hold rider(s) in other position(s) such as seated.

Each set of running rails may be formed as a closed loop. Alternatively, each set of running rails may be formed as an open loop, and the carriers may be detachable from the respective set of running rails and re-attachable for a subsequent ride. As another alternative, each set of running rails may be formed as an open loop, but a portion of each set of running rails at or near an end of the ride may be moveable to carry the carrier to a portion of the set of running rails at or near the embark point.

At least one of the sets of running rails consists of a single rail. Alternatively, or in addition, at least one of the sets of running rails consists of two rails.

Each set of running rails may be part of a respective track, and the tracks may be independent from one another.

Forward motion of each carrier on the respective set of running rails may be unpowered, other than by the launch system at the commencement of the ride. Alternatively, forward motion of each carrier on the respective set of running rails may be powered for only part of the ride, other than at the commencement of the ride. The carriers may be configured such that a rider can selectively apply the power at one or more sections of the ride.

The ride may comprise an anti-false start mechanism for each carrier that is configured to prevent a rider from launching the respective carrier prior to the ride commencement indication. Alternatively, or in addition, the ride may comprise a default start mechanism that is configured to launch the respective carrier after a predetermined period following the ride commencement indication if a rider fails to trigger the launch system.

The indicator may comprise or consist of a visual indicator. Alternatively, or in addition, the indicator may comprise or consist of an audible indicator.

In some embodiments, the sets of running rails, although being of substantially the same length, are configured to diverge and then converge to create the impression of one carrier falling behind another and then catching up, and vice versa.

The sets of running rails may be configured with one or more of the group consisting of: twists, turns, barrel rolls, loops, and inversions.

Preferably, at least one of the carriers comprises a mechanism for at least one rider to apply a steering action to the carrier as it traverses the respective set of running rails, the mechanism adapted such that effective steering results in a mechanical advantage for the carrier by reducing friction between the carrier and the set of running rails as the carrier traverses regions of the respective set of running rails. In the embodiments in which said at least one of the carriers is sized and adapted to carry multiple riders, the carrier may comprise a mechanism for each of the riders to apply a steering action to the carrier as it traverses regions of the respective set of running rails.

At least one of the carriers may sized and adapted to carry multiple riders, and wherein each of the riders of that carrier must activate a ride activator to trigger the launch system to commence the ride for that carrier.

Preferably, the launch system comprises a flywheel adapted to store energy, an energy source to rotate the flywheel, and two selective energy transfer mechanisms operatively connected to the flywheel, wherein each of the selective energy transfer mechanisms is operable, in response to actuation of a ride activator of a respective carrier, to independently transfer energy from the flywheel to the respective carrier to launch the respective carrier along the respective set of running rails.

At least one of the selective energy transfer mechanisms may comprise a mechanical clutch, an epicyclic gearbox, or a hydraulic motor for example.

In accordance with a third aspect of the present invention, there is provided a launch system for launching two carriers in an amusement ride, with each carrier adapted to carry at least one rider, the launch system comprising a flywheel adapted to store energy, an energy source to rotate the flywheel, and two selective energy transfer mechanisms operatively connected to the flywheel, wherein each of the selective energy transfer mechanisms is operable, in response to activation of the selective energy transfer mechanism, to independently transfer energy from the flywheel to a respective carrier to launch the respective carrier.

This aspect may be used with carriers adapted to hold rider(s) in substantially prone position(s), or may be used with carriers adapted to hold rider(s) in other position(s) such as seated.

Each selective energy transfer mechanism may be configured to be activated by at least one rider of a respective carrier. Alternatively, each selective energy transfer mechanism may be configured to be activated by a ride operator who is not riding in the carrier(s).

At least one of the selective energy transfer mechanisms may comprise a mechanical clutch, an epicyclic gearbox, or a hydraulic motor for example.

Preferably, the launch system comprises a pulley associated with each carrier and operatively connected to a respective one of the selective energy transfer mechanisms, and an engagement mechanism to engage the carrier and which is operatively connected to the respective pulley, the launch system configured such that activation of the selective energy mechanism results in rotation of the respective pulley, to launch the carrier.

The invention consists in the foregoing and also envisages constructions of which the following gives examples only.

BRIEF DESCRIPTION OF DRAWINGS

The invention will be further described by way of example only and without intending to be limiting with reference to the following drawings, wherein:

FIG. 8B shows a schematic overhead view of the amusement ride of FIG. 8A;

FIG. 8C shows a schematic end view of the amusement ride of FIG. 8A;

DETAILED DESCRIPTION OF PREFERRED FORMS

Figure 1:
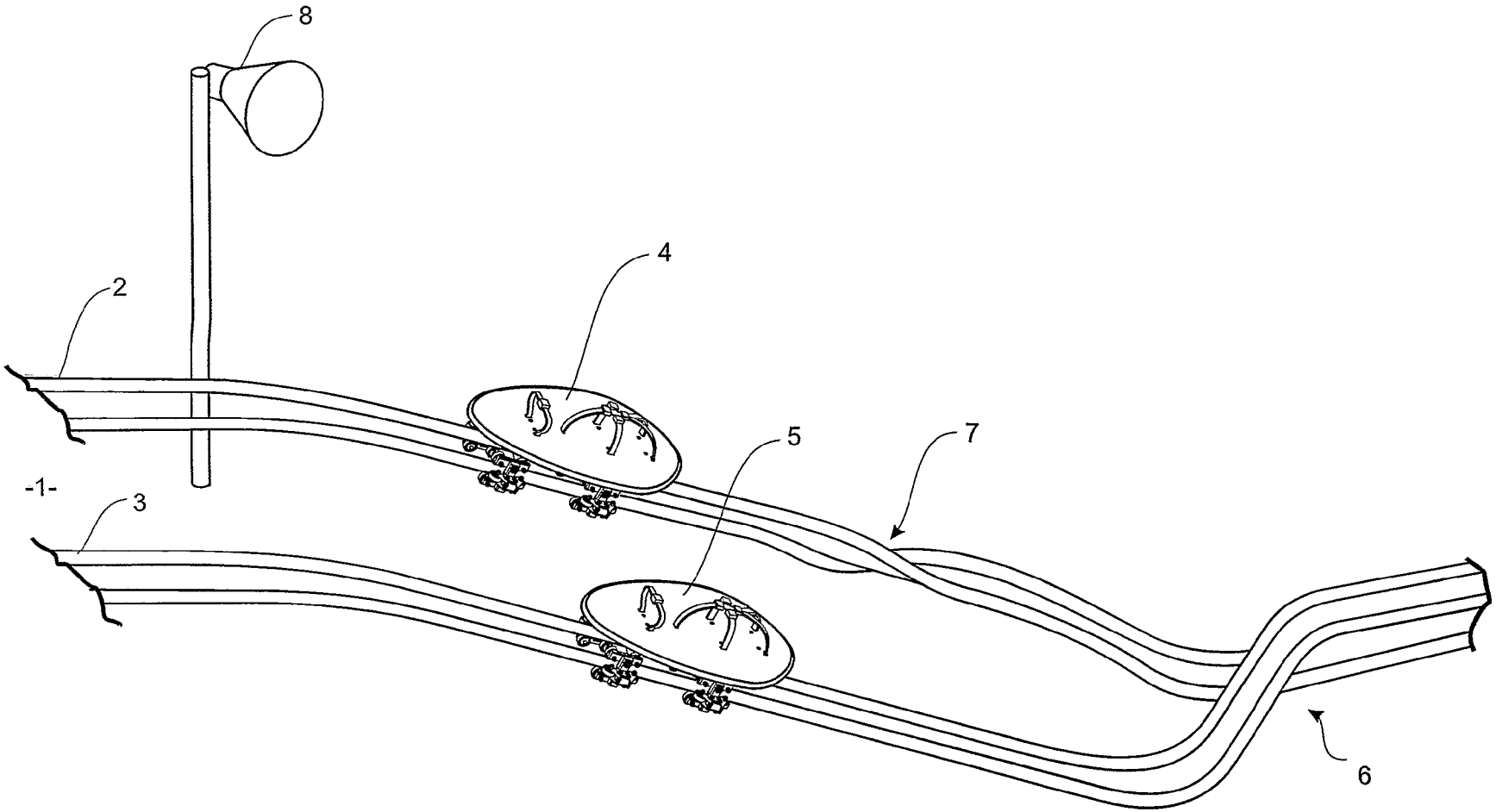
FIG. 1 shows the start of an amusement ride in accordance with a first embodiment of the invention.

FIG. 1 shows the start of one embodiment of a drag racing roller coaster amusement ride of the invention. The amusement ride starts from start point 1 with one separate set of running rails 2, 3 for each carrier 4, 5. Running rail sets 2 and 3 converge to a single track at point 6.

At or near the start point 1, a platform may be provided that defines an embark point so that riders can be harnessed into the carriers 4 and 5. At or near the start point 1 is provided an indicator that will provide the riders with an indication of the when the ride can start; ie a ride commencement indication. In FIG. 1, this indicator is indicator 8 that may provide an audible countdown or any other suitable indication of when the ride may commence. Carriers 4 and 5 each include a ride activator controllable by a rider of the respective carrier to trigger a launch system to provide an initial powered motion to launch the carrier at the beginning of the ride.

The amusement ride may comprise a secondary means or anti-false start mechanism to ensure that even if the riders activate the ride activators they will not be able to commence the ride prior to the indication being given by indicator 8. This secondary means may be a braking means on the carrier that is not released until the indication is given by the indicator, or the secondary means may be a deactivation of the activation means provided on the carrier. The secondary means works in synchronisation with the indicator so that as soon as the indicator indicates to the riders that they may commence the ride the deactivation means is deactivated and the riders can activate the ride. In preferred embodiments, a default start mechanism may be provided to launch either carrier if the rider fails to activate the ride after the indicator has provided a start of race indication. In preferred embodiments the means to launch the carrier should the rider fail to do so is activated after a predetermined pause following the start of race indication by the indicator, such as a pause of one second for example. As well as still providing for an interesting race between the riders even if one rider should not launch their carrier promptly, this will assist in providing satisfactory ride throughput.

Initial power for the ride may come from any suitable propulsion means or launch system. For example, the ride may include a squirrel cage rotary motor, linear induction motors, a pneumatic launch system, a hydraulic launch system, an elastic launch system or a counterweight system that can be activated by the riders. Alternatively any other suitable power means may be provided. If a squirrel cage electric motor is used as the propulsion means, the squirrel cage electric motor may be used to drive a cable or chain to propel the carriers via a temporary engagement means. The temporary engagement means are well known art.

Figure 14:
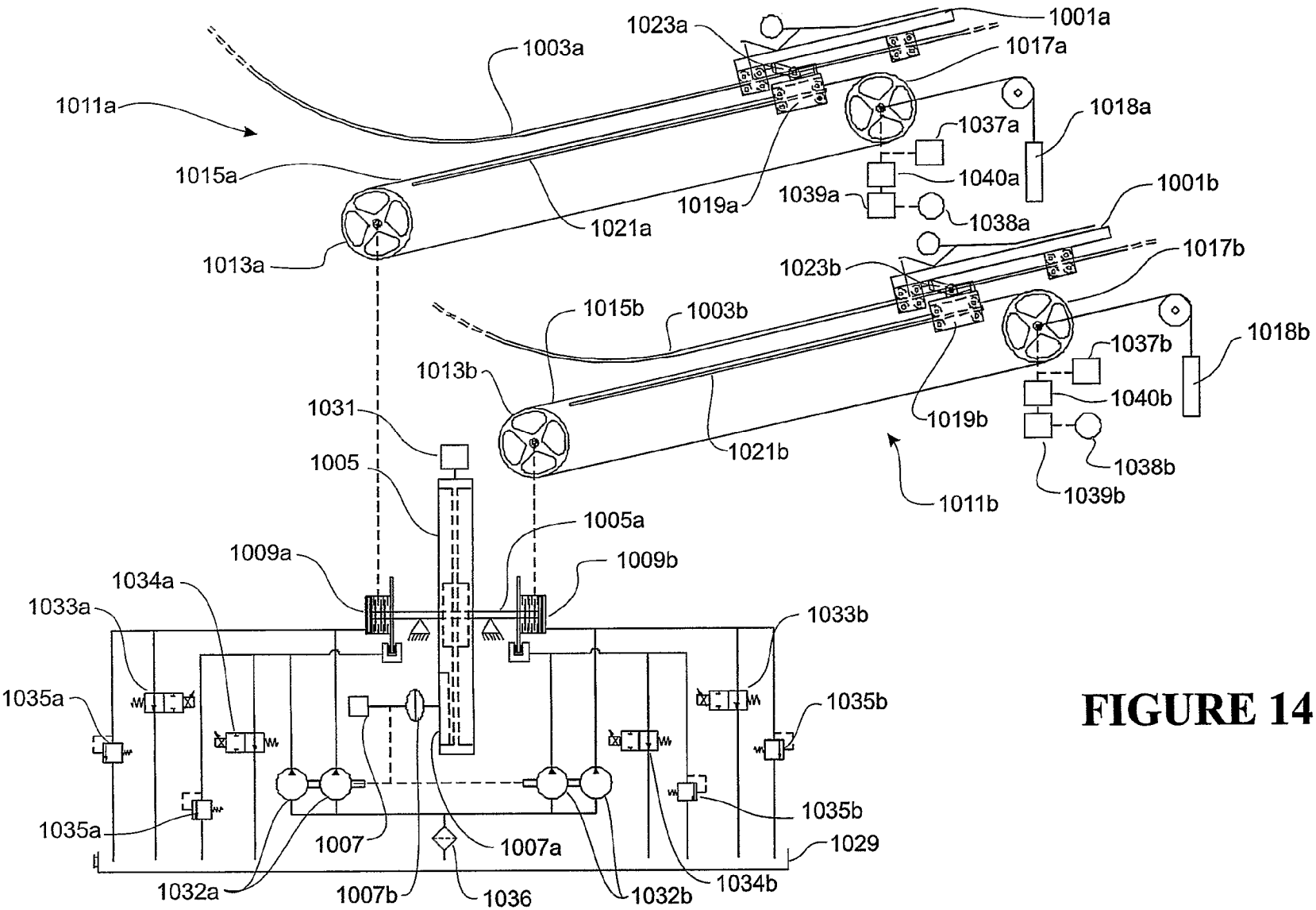
FIG. 14 shows a schematic diagram of a first preferred embodiment launch system.
Figure 15:
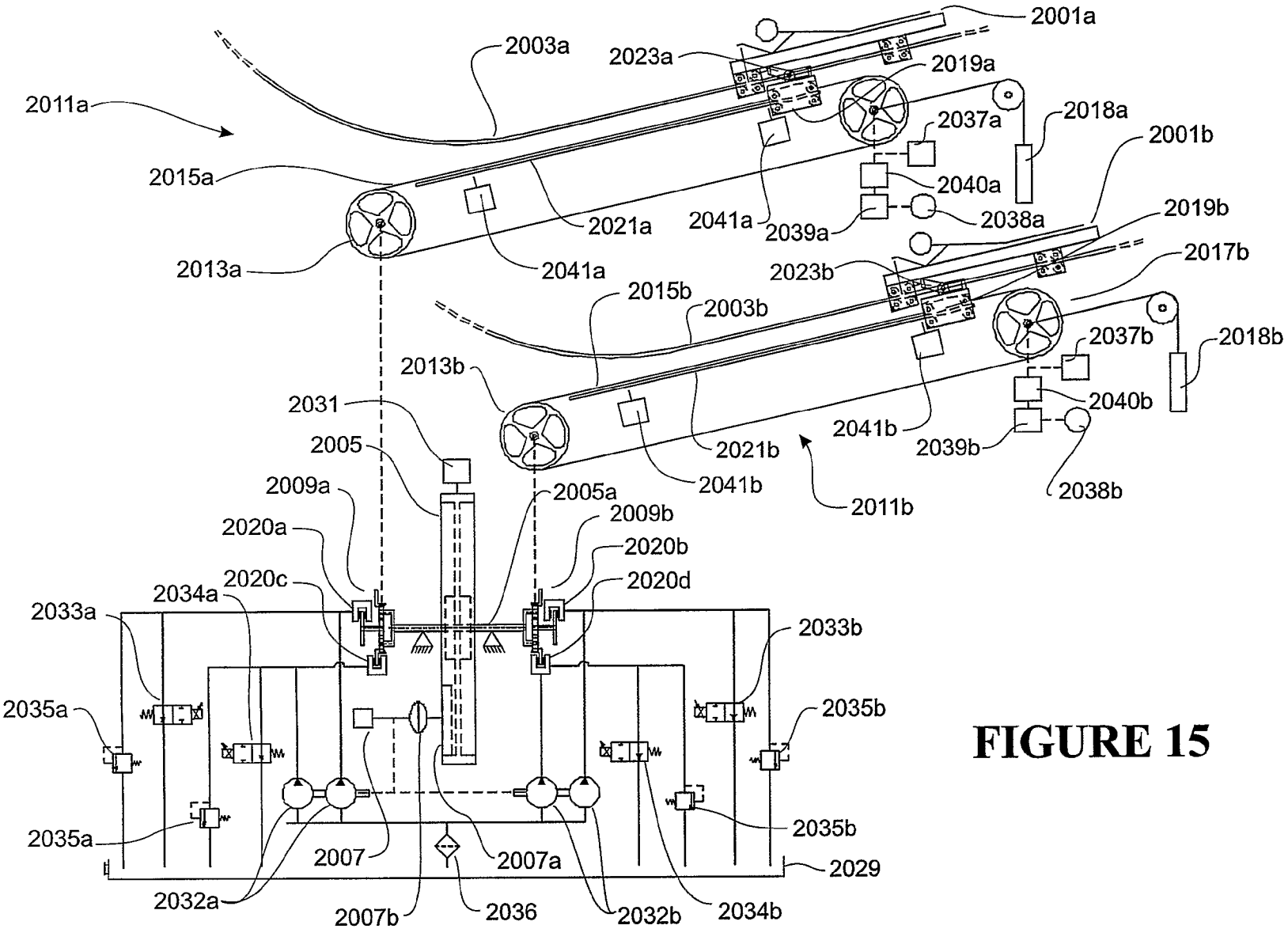
FIG. 15 shows a schematic diagram of a second preferred embodiment launch system.
Figure 16:
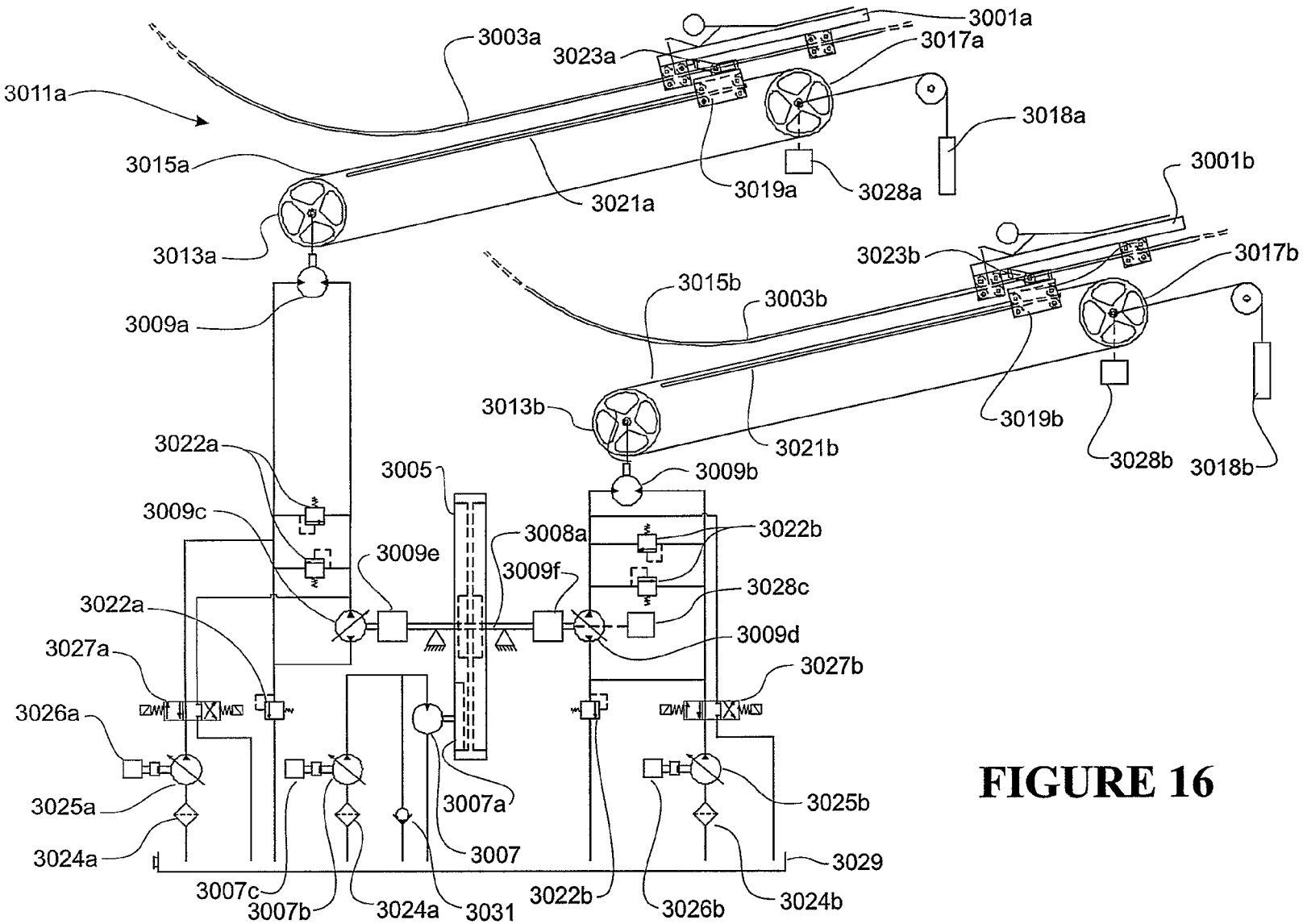
FIG. 16 shows a schematic diagram of a third preferred embodiment launch system.

Preferred embodiment launch systems for use in the ride of FIG. 1 are shown in FIGS. 14 to 16 and described below.

The sets of running rails at the start of the ride may include an initial up hill climb. Alternatively the riders may be launched along a substantially horizontal launch path or downhill (on a launch ramp) to gain sufficient momentum to reach the top of an initial climb. The launch system that the riders may activate will provide sufficient initial power to get the riders to the top of the initial climb following which the ride proceeds at least partly by gravity down a slope, or series of rises and falls, in the manner of the roller coaster.

Forward motion of each carrier on the respective set of running rails may be unpowered, other than by the launch system at the commencement of the ride. Alternatively, forward motion of each carrier on the respective set of running rails may be powered for only part of the ride, other than at the commencement of the ride. The carriers may be configured such that a rider can selectively apply the power at one or more sections of the ride. Alternatively, the power may be applied without rider intervention.

The sets of running rails 2 and 3 are substantially the same length for the ride and are substantially equivalent overall so that each carrier moves the same distance along the ride in a substantially equivalent style so as to increase the perception of a fair contest where possible. The sets of running rails, although being of substantially the same length, may be configured to diverge and then converge to create the impression of one carrier falling behind another and then catching up, and vice versa.

One, both, or all of the sets of running rails may consist of a single rail. One, both, or all of the sets of running rails may consist of two rails, or of more than two rails.

Each set of running rails may be part of a respective track, and the tracks may be independent from one another for the duration of the ride. Alternatively, the sets of running rails may be independent in places as shown at start point 1 of the ride in FIG. 1 and converge into a single track as shown at point 6 of FIG. 1 for at least part of the ride. After the running rails converge to a single track they may split again and reconverge at one or more points along the ride. As can be seen in FIG. 1 prior to convergence one set of running rails 2 may rotate so that the carrier is in a position underneath the running rails as opposed to on top of the running rails as it was at the start of the ride.

At various points along the ride one or both of the carriers may be in an upside down or inverted position and the relative positions of the carriers alter during the ride. Using the sets of running rails and the initial powered launch allows the riders to apparently race each other along the track. The sets of running rails may include one or more twists, turns, barrel rolls, loops, inversions, top hats, and/or other features found on roller coaster type tracks. In preferred embodiments the running rails are supported above the ground in a manner that may be similar to a roller coaster support structure. Support of the running rails is discussed in more detail with reference to FIGS. 3 and 8.

In use riders are strapped to the carriers at an embark point which is preferably at or near start point 1 of the track. The riders in the carriers then proceed to start point 1 or launch point of the track.

In preferred embodiments at the start point the sets of running rails for each carrier are separate but side by side. The riders then receive an indication from the indicator that the ride may commence and upon receiving the indication can activate a ride activator on each carrier. The rider with the better reflexes will be able to activate the launch system first to provide a powered initial motion to the carrier, and thus gain an advantage in the apparent race of the ride. The carriers then proceed along part of the set of running rails, such as a launch ramp, to a point where the track rises to a high point under the momentum of the launch. The sets of running rails are preferably arranged so that the riders descend thereafter at least partly by gravity along the ride. The ride may be arranged so that at different points along the ride it is apparent which rider is proceeding down the ride first but at other points along the ride it may be difficult to tell. For example it may appear as if a first rider has slowed down only to catch up and pass a second rider at greater speed along the running rails provided for the first rider. Twists and turns in the rails and in the speed of each rider varying at different points along the ride provide excitement to the riders and the sensation of racing.

The racing sensation is enhanced by the riders' capability to begin the race upon receiving the start indication. Additionally, as will be described below with reference to FIG. 11, the carriers may each comprise a mechanism for at least one rider to apply a steering action to the carrier as it traverses the respective set of running rails, the mechanism adapted such that effective steering results in a mechanical advantage for the carrier by reducing friction between the carrier and the set of running rails as the carrier traverses certain regions of the set of running rails, such as turns, spirals, or rolls.

At the end of the ride the carriers and riders cross a nominated finish line and proceed to finish at a stop point or end point. The end point of the ride may be very close in proximity to the start point of the ride or may be the same as the start point of the ride. In the preferred embodiments each set of running rails forms a closed loop so that the carriers may be able to move seamlessly from the end point of the ride to the start point; that is without re-traversing any part of the set of running rails traversed during the ride.

Alternatively, each set of running rails may be formed as an open loop, and the carriers may be detachable from the respective set of running rails and re-attachable for a subsequent ride. To that end, it is preferred that the carriers are sufficiently lightweight to be manually lifted onto and off from the sets of running rails. In another embodiment, each set of running rails may be formed as an open loop, but a portion of each set of running rails at or near an end of the ride, or a separate carrier support, is moveable to carry the carrier to a portion of the set of running rails at or near the embark point.

These embodiments enable each set of running rails to have a queuing region configured such that as one carrier is traversing a set of running rails, one or more carriers and riders can be queued ready for launch on that set of running rails. Such a configuration is shown in FIGS. 8 and 9.

Figure 2:
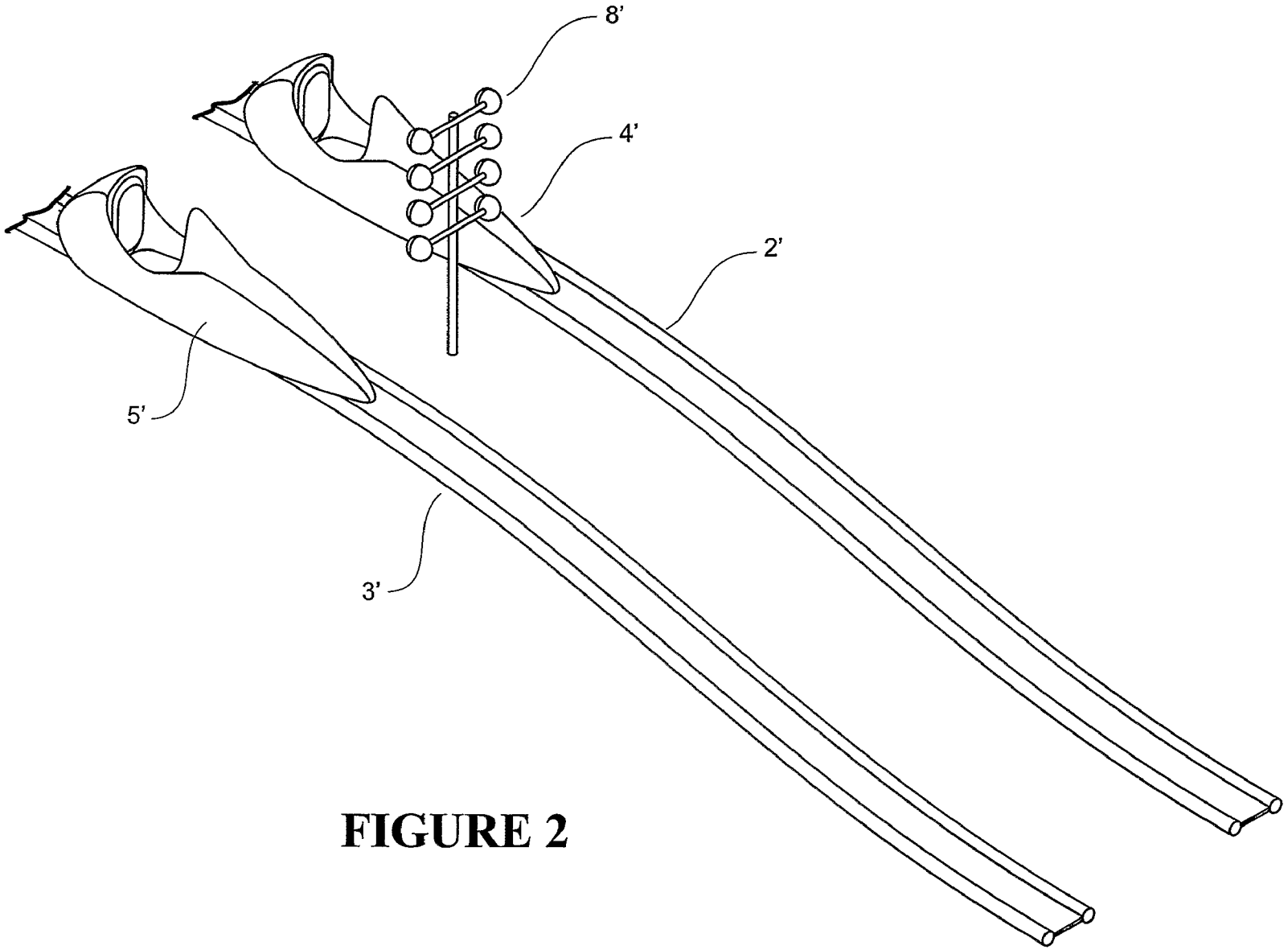
FIG. 2 shows the start of an amusement ride in accordance with a second embodiment of the invention.

FIG. 2 shows a second embodiment ride. Like reference numerals are used to indicate like parts, with the addition of a prime (′). In this embodiment the carriers are arranged so that the riders are sitting in the carriers and suitable harnesses (not shown) are provided to keep the riders securely in the carriers. It is preferred for many embodiments that the riders are in substantially prone positions, to lower their centers of gravity. However, the embodiment of FIG. 2 has application with some aspects of the invention, such as a queued start racing ride, and with any of the launch systems described below with reference to FIGS. 14 to 16. In FIG. 2, the indicator for indicating the start of the ride is a set of lights. These lights may be similar to those found in drag racing situations to provide a drag race feel to the start of the ride. In addition, or instead, an audible signal may be given. Background sound effects and lighting effects may be installed to add to the pre-race atmosphere. This type of indicator could be used in the embodiment of FIG. 1.

As shown in FIG. 2 the running rails in some embodiments may not converge along the ride and may be totally independent for the duration of the ride, thereby forming independent tracks. In some embodiments the running rails may run substantially parallel for the length of the ride. In other embodiments, the sets of running rails, although being of substantially the same length, are configured to diverge and then converge to create the impression of one carrier falling behind another and then catching up, and vice versa.

At the finish end of the running rails in the ride of FIG. 1 or 2, the ride may be substantially horizontal or may curve up slightly to slow the rider(s) to a stop. Alternatively other means of stopping the rider(s), such as a magnetic or mechanical braking system, may be used.

In one embodiment the running rails are rigid members. The rigid members may be a beam or a plurality of beams or pipes enjoined to form one rigid member. Although described as rigid, it is known that there may be some flexing due to the weight of the member itself and the weight of the riders moving along it. Each set of running rails, may converge with one or more other sets of running rails for portions of the length of the running rails. For example, if three sets of running rails a, b, c are provided for three carriers initially running rails a and b may converge. Following this rails a and b may split up and rails b and c may converge. After the convergence of rails b and c these may be joined by running rails a. The above example is one of many different running rail configurations that may be used with a ride of the invention. Any number of sets of running rails may be provided on the ride. In the embodiment of FIG. 1, track 2 has four running rails (not shown), two forming each set for each rider 7, 8.

Where it is desired to arrange a set of running rails so as to impart side to side motion to the riders, for example to alter the quality of the ride, then the running rails may alternatively be supported by cables or other non-rigid means so that the running rails are not fixed in space.

The attachment means or the running rails may also include a braking system arranged to slow the carriers and riders at the stop end of the ride or during the course of the ride to control speed. The braking system may be magnetic and automatically slow a carrier as it passes a position on the running rails. Typically this will occur at or near the end of the ride but alternatively it may also occur at other points along the running rails. Alternative braking systems can also include operator controlled braking and rider controlled braking or a combination of systems.

The carriers may be sized and adapted to carry a single rider or a plurality of riders, preferably a maximum of four riders. The carriers are preferably arranged so that each rider is in a substantially prone position during the ride. The advantages of a prone position for each rider include that greater 'g forces' can be accommodated on the set of running rails, a wider range of maneuvers, and greater speeds can be achieved by the riders when compared to a ride in which the riders are seated and the upper parts of the riders' bodies are substantially erect. Similar benefits are offered when each set of running rails has two or more rails, rather than a singe rail.

Figure 4:
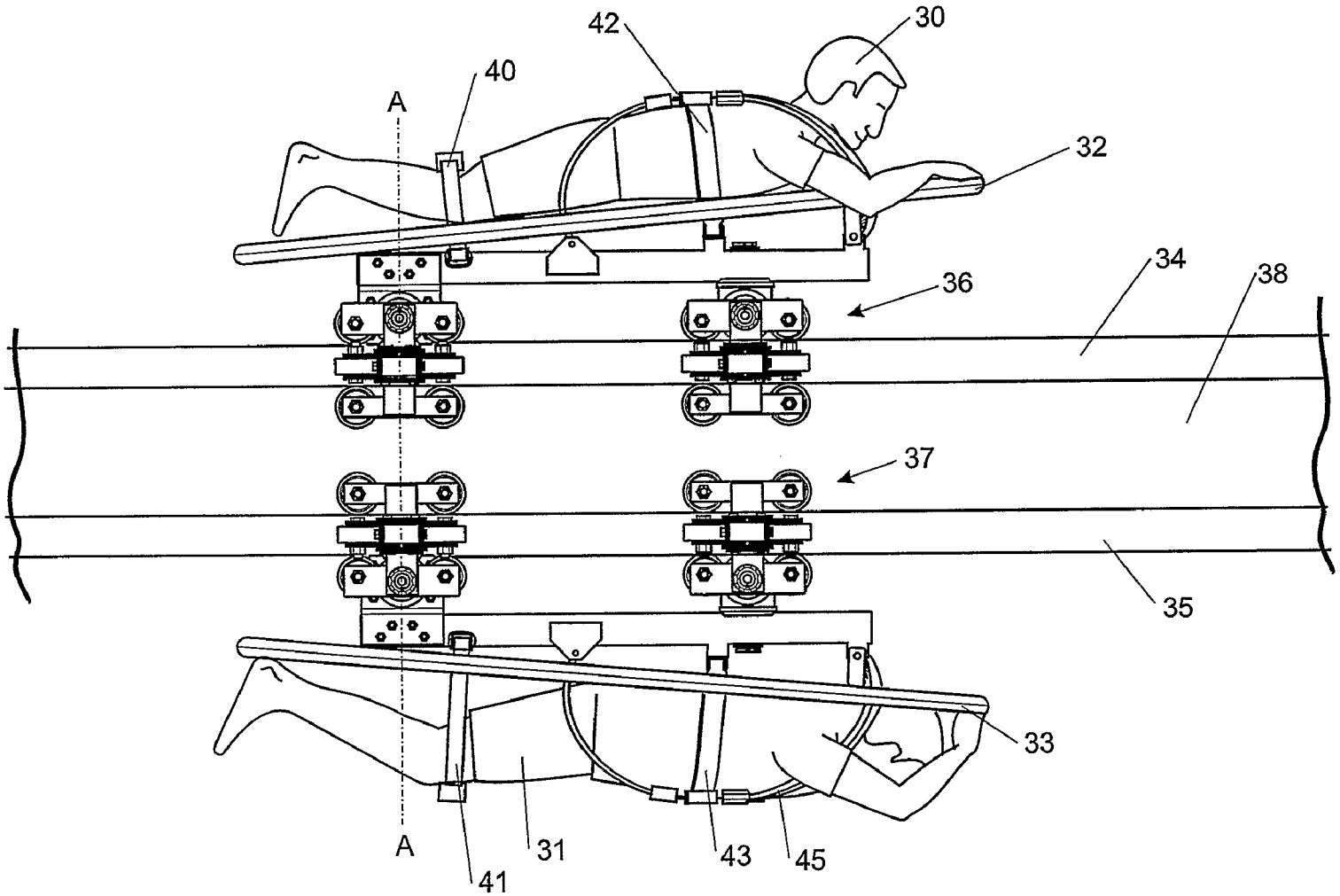
FIG. 4 shows two riders on respective sets of running rails of a preferred embodiment the invention.
Figure 10A:
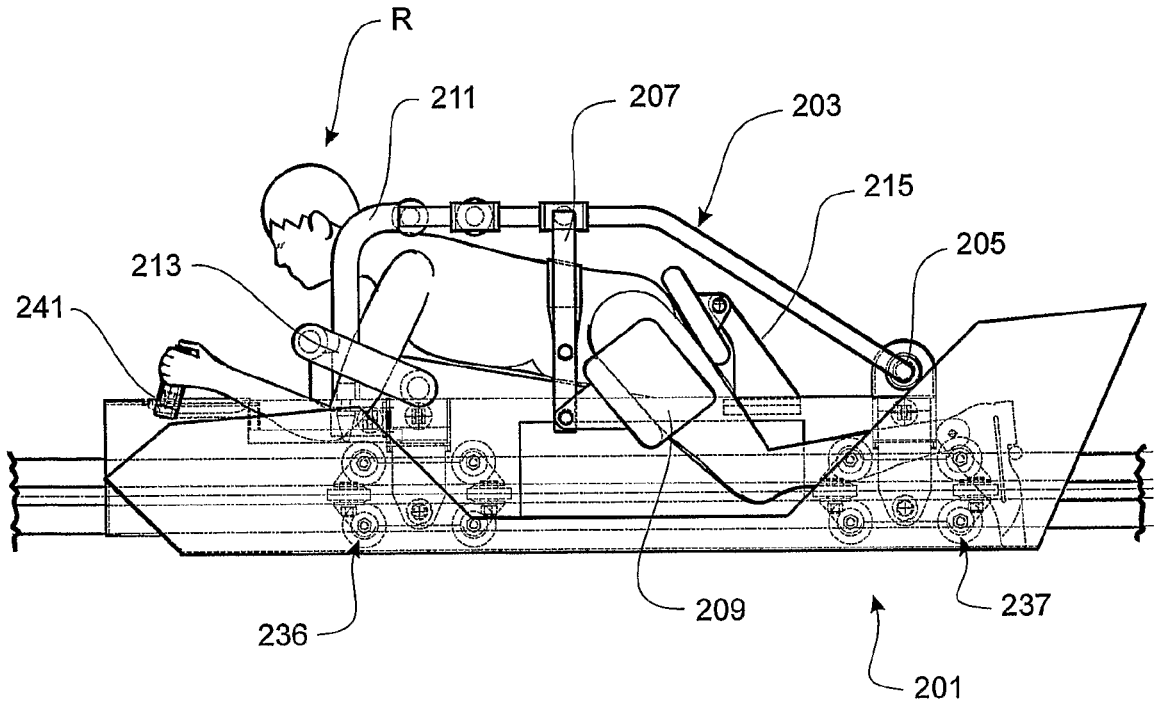
FIG. 10A shows a side view of an alternative preferred embodiment carrier for use in the invention.

At least one of the carriers may be sized and adapted to carry a maximum of four riders, each in a substantially prone position. Such a carrier preferably has an unloaded weight of less than about 500 kg. At least one of the carriers may be sized and adapted to carry a single rider, such as shown in FIG. 4 or 10 for example. Such a carrier preferably has an unloaded weight of less than about 300 kg, more preferably less than about 100 kg. At least one of the carriers may be adapted to carry a minimum of one rider and a maximum of two riders. Such a carrier preferably has an unloaded weight of less than about 450 kg, more preferably less than about 200 kg.

Carriers adapted to carry multiple riders may each have a plurality of interconnected carrier units, each adapted to carry a single rider. Such a configuration is shown in FIG. 12 and described below.

In preferred embodiments the only force on a rider as the rider descends the ride is gravity after the riders have passed a high point of the ride. In alternative embodiments known mechanical or electrical power or other known means of propulsion may be provided on the carriers and/or on the tracks. The rider may be propelled at least part way along the track by compressed air or gas. In alternative embodiments other forms of propulsion may be used.

A rider on a set of running rails above the track may be directly above a rider in a carrier on a set of running rails below the track. Alternatively the rider on the set of running rails above the track may not be directly above a rider in a carrier on the set of running rails below the track. Alternatively again the riders may be substantially parallel on independent sets of running rails for the ride. While, as described below with reference to FIG. 4, the riders could be simultaneously held above and below a track on the ride, it is preferred that the carriers run side-by-side for at least part of the ride to enhance the sensation of racing. As such, each carrier may be configured to support the rider(s) suspended below the respective set of running rails. Alternatively, each carrier may be configured to support the rider(s) above the respective set of running rails. The carriers may be interchangeable, and configured to support the rider(s) either above or below the respective set of running rails.

More than one carrier may be engaged with a set of running rails. So long as the carriers are spaced apart and one carrier cannot catch up with the carrier in front a plurality of carriers may use the same set of running rails concurrently. The means for ensuring the carriers are spaced apart aforesaid can be known track management or "blocking" systems.

Figure 3:
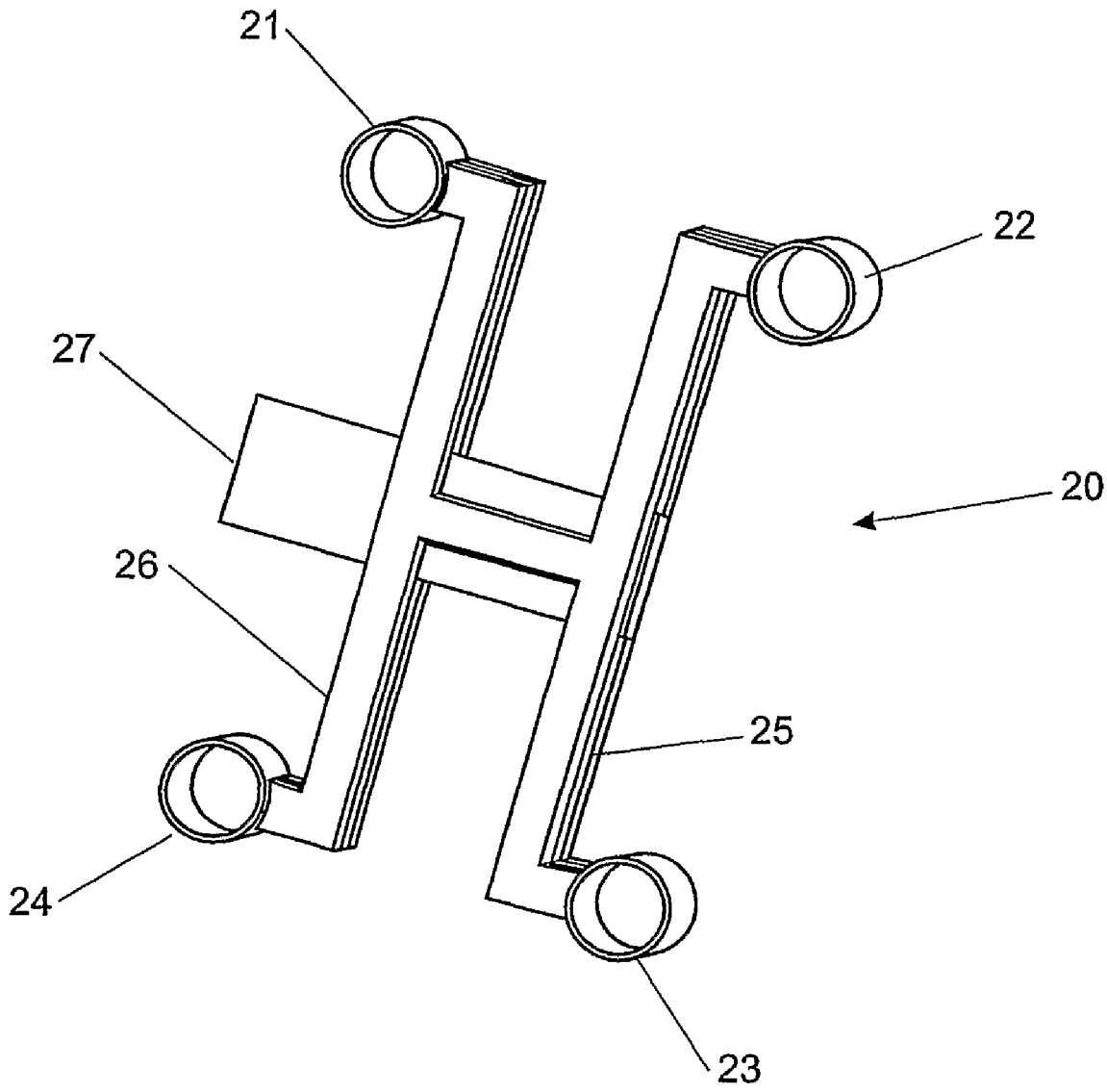
FIG. 3 is a cross-sectional view of one preferred embodiment set of running rails.

FIG. 3 is a cross-sectional view of a portion of one embodiment of track that may be used as part of the ride of the some embodiments of the invention. The track in FIG. 3 includes four running rails 21, 22, 23 and 24 with two connecting pieces 25 and 26 connecting the running rails and a supporting member 27 extending between the connecting members. As shown in FIG. 3 in one embodiment each running rail is tubular to allow engagement with the carrier. In this embodiment the running rails 21 and 22 are the set of running rails for a first carrier and the running rails 23 and 24 are the set of running rails for a second carrier. In one embodiment the support members 25 and 26 may each comprise a plurality of supports between the respective running rails to hold the running rails in place. An alternative embodiments supports 25 and 26 may be solid along the length of the running rails. Supports 27 are periodically attached to supports 25 and 26 and attach the track to a structure or pole for example. In some embodiments more than two running rails are provided in each set of running rails. It should be noted that there may be a different number of running rails provided in each set of running rails.

In the embodiment of track shown in FIG. 3 the running rails are hollow tubes or pipes. In an alternative embodiment different shapes of running rails may be used. For example each running rail may form a T or H cross section that provides surfaces for the wheels of the carrier to engage with. In other embodiments a single running rail is provided for each carrier. For example, each set of running rails may consist of a single T-shaped member, with the upper part of the T forming the rail. In further alternative embodiments the running rails may be arranged so that more than two carriers may use the ride at each time. Each carrier may run on its own set of running rails with, in preferred embodiments, no running rail(s) shared between carriers. This allows the rides to be completely independent of each other.

Figure 5A:
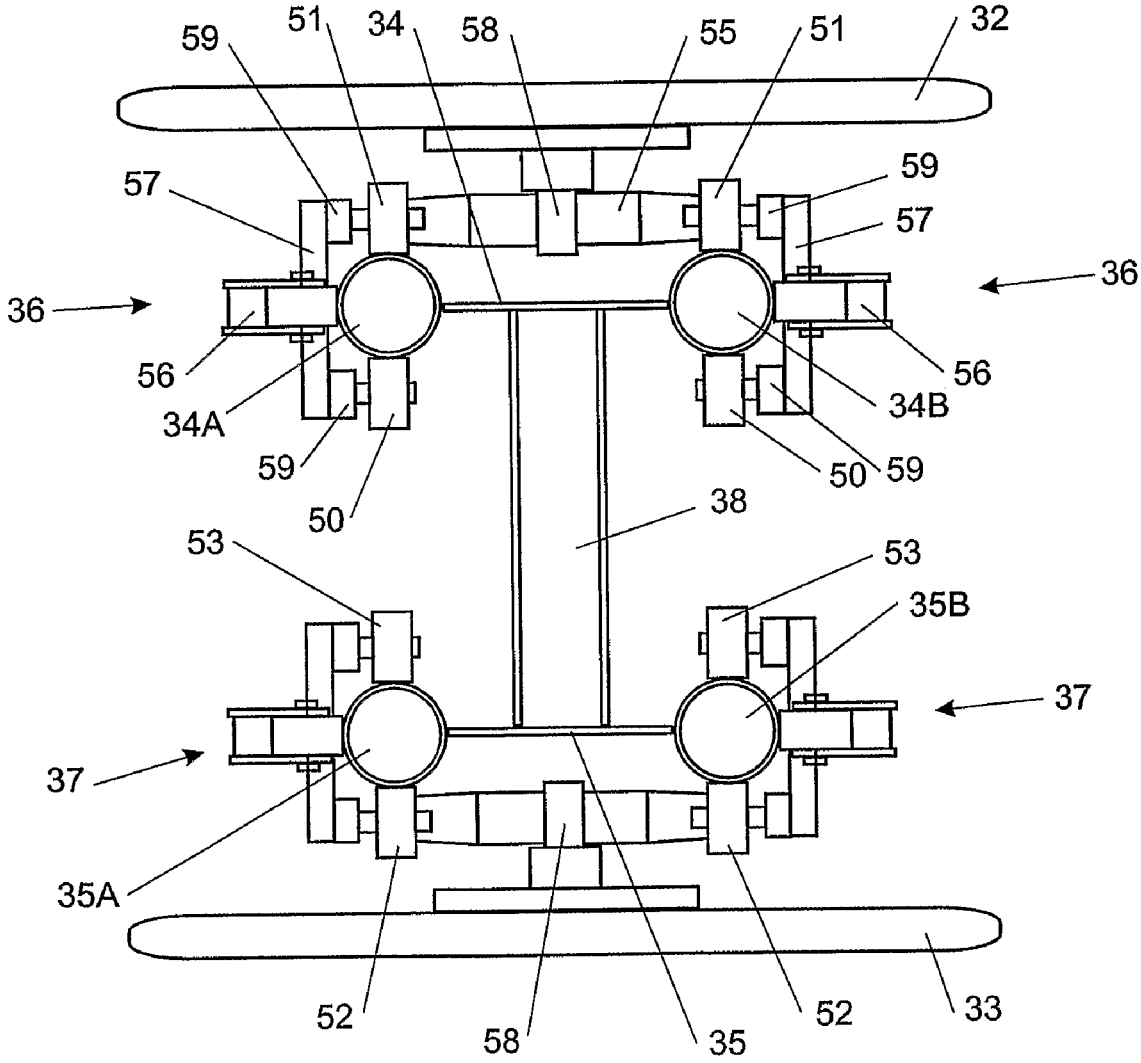
FIG. 5A is an end view of sets of running rails and carriers and wheel assemblies of a preferred embodiment of the invention.
Figure 5B:
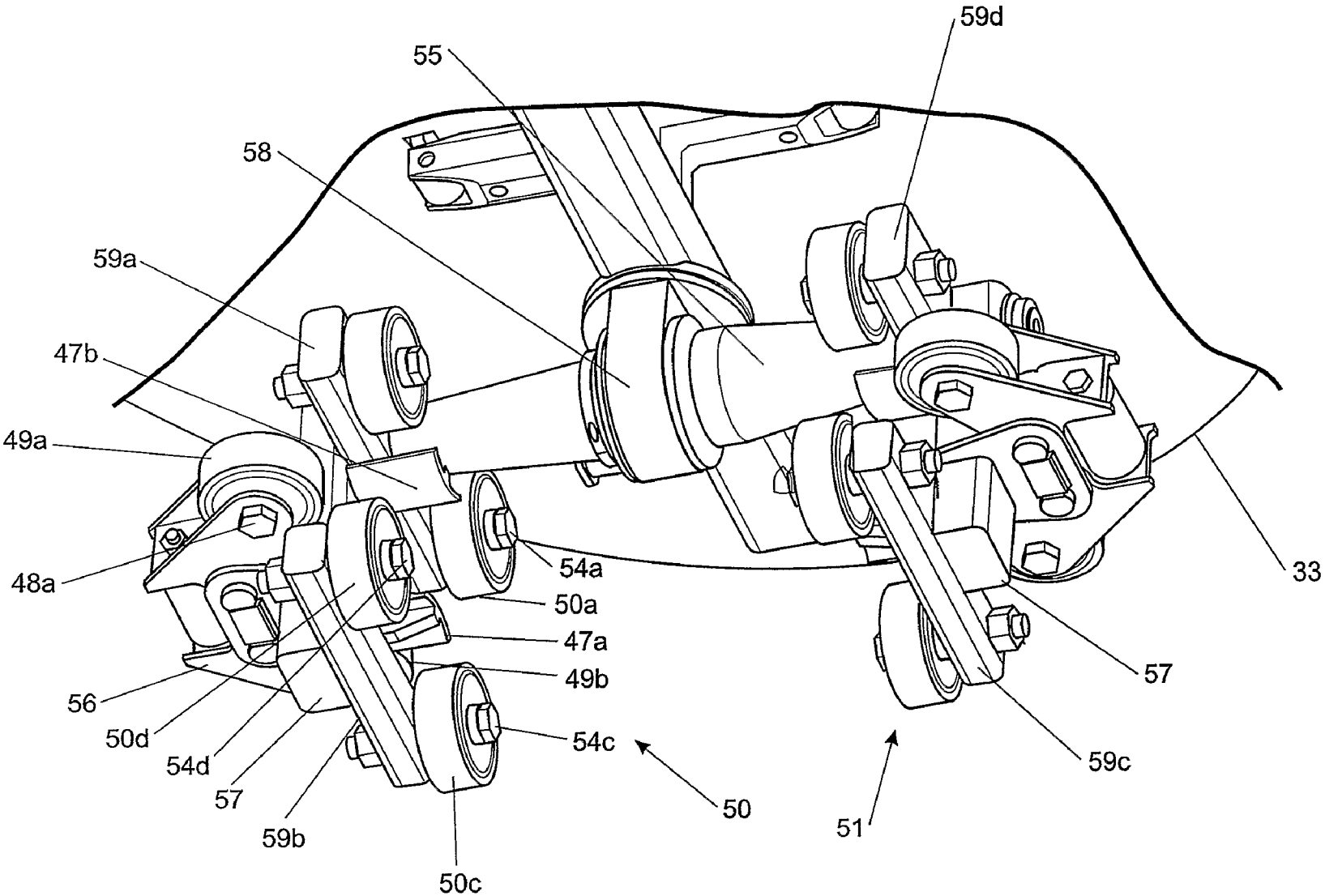
FIG. 5B is an underside perspective view of a wheel assembly of FIG. 5A.
Figure 5C:
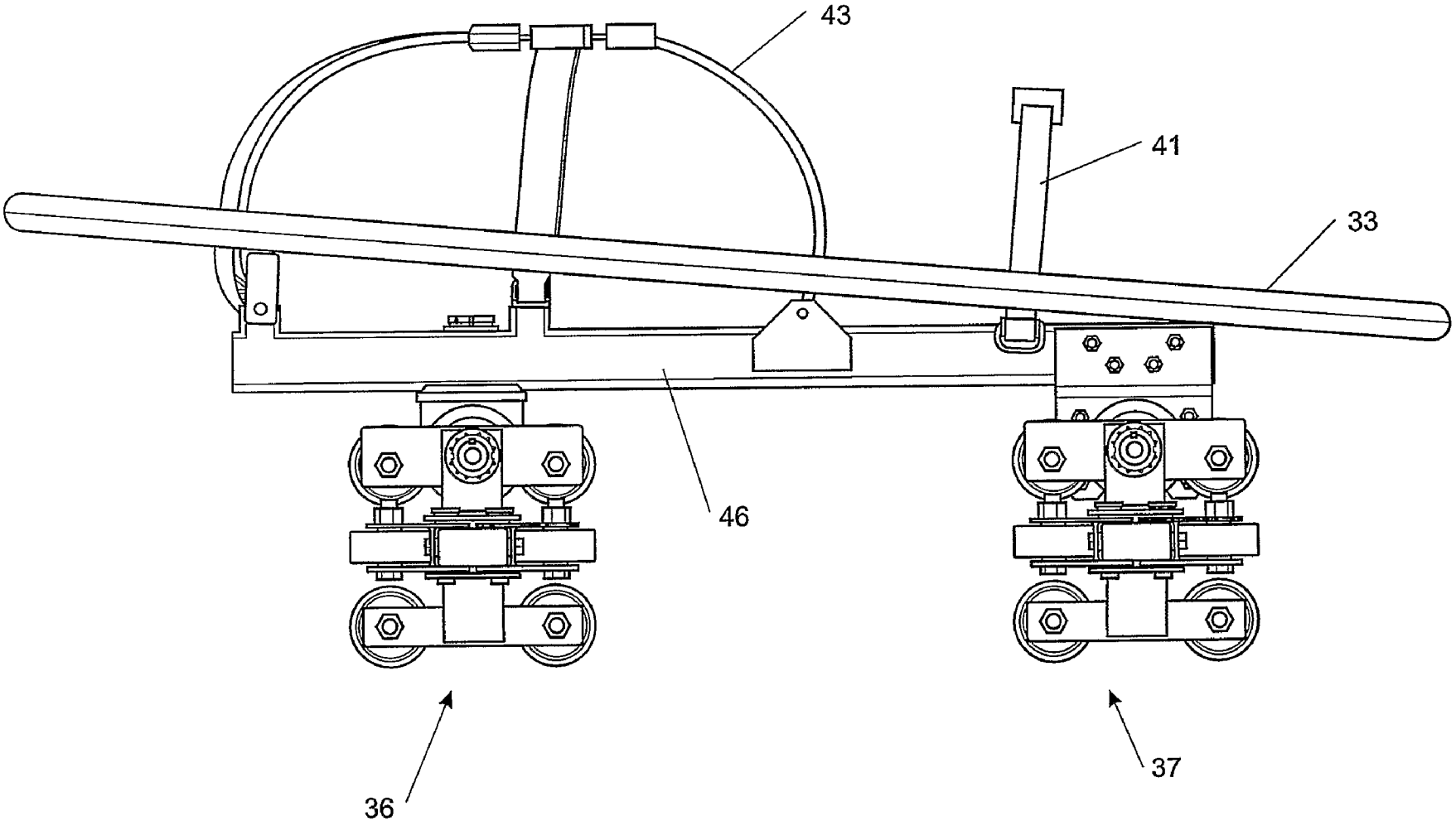
FIG. 5C is a side view of a carrier and wheel assembly in accordance with a preferred embodiment of the invention.

FIG. 4 is a side view of one portion of a track 38 that may form part of a ride of the invention showing two riders on respective running rails 34 and 35. Each carrier may also be slidingly engaged with at least one other running rail (shown in FIG. 5A). The connections between the running rails are not shown in FIG. 4. At this point along the track, rider 30 is a prone position above running rail 34 and rider 31 is in a prone position beneath running rail 35. Riders 30 and 31 are harnessed into carriers 32 and 33 by harness pieces 40-45. Carriers 32 and 33 move slidingly along running rails 34 and 35 using attachment means 36 and 37. In this embodiment the attachment means are wheel assemblies. FIGS. 5A-5C show one embodiment of the wheel assemblies in more detail. In this embodiment two wheel assemblies are used, however in other embodiments a different number of wheel assemblies may be used.

In the portion of track shown in FIG. 4, the center of gravity of riders 30 and 31 is close to the center of gravity of the sets of running rails. By having the riders prone and the center of the riders close to that of the track, there is less pitch and roll during the ride, lower centrifugal forces on the riders, and less onerous dynamic loads on the track. Prone riders allows for a lighter weight and less costly track and support structure construction. The track section shown in FIG. 4 is straight but it should be noted that the running rails may twist or turn or even barrel roll. If the track does a half barrel roll, rider 30 will be positioned below the track while rider 31 will be above the track. It should be noted that the carriers 32 and 33 used in this embodiment are substantially identical so that each carrier may safely carry a rider whether the carrier is below or above the track.

FIG. 5A is a view taken through line AA on FIG. 4 and without riders 30 and 31 in place and shows one embodiment of wheel assemblies that may be used as part of the ride of the invention. As can be seen in FIG. 5A, track 38 includes two sets of running rails 34A, 34B, 35A and 35B to which carriers 32 and 33 are slidingly engaged via wheel assemblies 36 and 37. As shown in FIG. 4, in this embodiment each carrier has two wheel assemblies or bogies designated by numerals 36 and 37. Each wheel assembly or bogie includes a set of wheels around each running rail engaged with the carrier. Upper carrier 32 includes first wheels 51 and second wheels 50. The carrier also includes section 58 through which axle 55 runs. Axle 55 connects the first wheels 51 and second wheels 52 together through cross pieces 57. Cross pieces 57 then extend down to perpendicular pieces 59 which are connected to the first and second wheels 50 and 51. Joint 56 along cross piece 57 may be a guide to keep the carrier in place along the running rail or may be connected to further wheels. The wheel assembly is repeated for lower carrier 33 which has lower axle 55 connecting first wheels 53, second wheels 52 and carrier 58 as well cross piece 57 and perpendicular pieces 59 connecting cross piece 57 with the first and second wheels 51 and 52. Again center portions 56 of the cross pieces 57 may be connected to wheels for guides to keep the carriage in place on the running rails.

FIG. 5B is an underside perspective view of one preferred embodiment wheel assembly. As can be seen in this Figure, the wheel assembly is attached to the underside of carrier 33. The wheel assembly includes section 58 that attaches the remainder of the wheel assembly to the carrier support. Axle 55 runs through section 58 to first and second wheel assemblies 51 and 50. In this embodiment first and second wheel assemblies are mirror images of each other. This embodiment is suitable for tracks in which the carrier engages with two running rails each of which is a mirror image of the other. Wheel assembly 50 extends from cross piece 55 via cross piece 57. Cross piece 57 is connected to cross piece 55 and also secondary perpendicular pieces 59A and 59B. Each of secondary perpendicular pieces 59A and 59D is attached to a plurality of wheels 50A-50B through axles 54A-54D. In the embodiment shown perpendicular sections 59A and 59B include two wheels each, however, different number of wheels may be provided on these perpendicular cross pieces. The perpendicular cross pieces 59A and 59B or cross piece 57 also include guards 47A and 47B that assist in aligning the wheels on the running rails. A further wheel assembly is provided perpendicular to wheels 50A-50D and sits on the outside of the running rails. This wheel assembly is attached to cross piece 57 by pieces 56 and includes wheels 49A, 49B and axles 48A and 48B. Again a different number of wheels could be used and attached to the secondary cross piece. The wheels will be made of any suitable material and the preferred embodiments are hardwearing so that they do not need frequent replacement. It should be noted that this embodiment of the wheel assembly is just one embodiment and different wheel assemblies may be used.

If the carrier is arranged to slidingly engage with less or more than two running rails, the configuration of the wheel assembly(s) will differ accordingly.

FIG. 5C is a side view of a carrier in accordance with a preferred embodiment of the invention. This carrier includes wheel assemblies 36 and 38 of the type described with reference to FIG. 5B. The wheel assemblies are attached to cross piece 46 which is then attached to carrier base 33. As can be seen from FIG. 5C the attachment means of each of the wheel assemblies is different. This may be the case on any carrier or alternatively the same attachment means may be used to attach the wheel assemblies to the carrier. As can be seen in FIG. 5C in this embodiment the carrier is set at an angle to the cross piece and wheel assemblies. In alternative embodiments the carrier may be parallel to the cross piece and wheel assemblies. The carrier also includes a harness shown by harness piece 41 and harness piece 43. The harness for the carrier will be described in more detail with reference to FIG. 6.

In preferred embodiments, the harness is designed to be light weight and the carriers are designed to be light weight in order that they may be carried by a set of running rails and manhandled without mechanical assistance as previously described. Although in FIGS. 5A-5C only two wheel assemblies are shown for each rider, more wheel assemblies may be used. It should also be noted in the embodiment of FIG. 5A that the wheel assemblies 36 and 37 do not extend further outwards than the carriages 32 and 33 and so to help to assist in providing a feeling a danger and acceleration to the riders.

Figure 6:
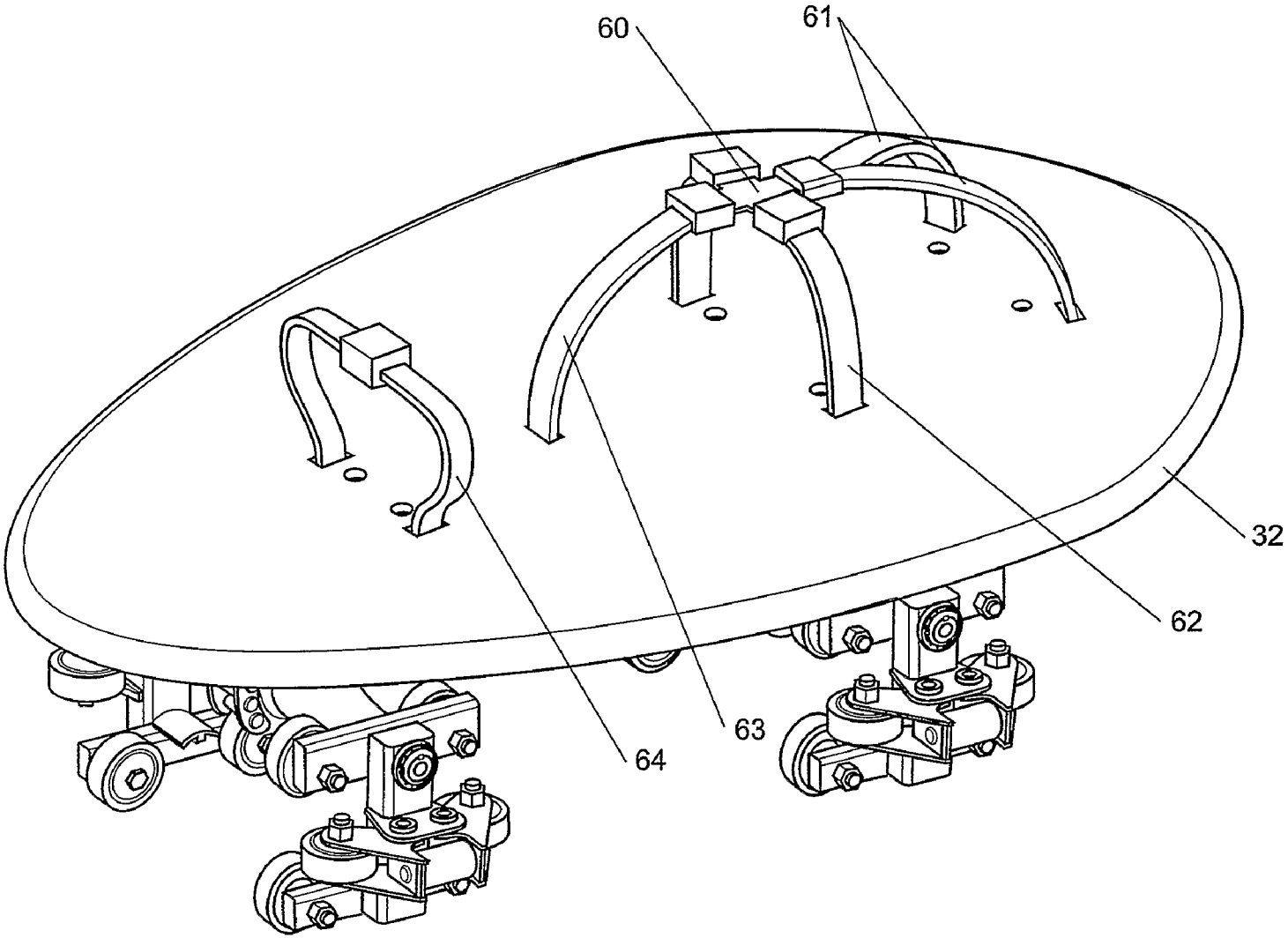
FIG. 6 is an overhead perspective view of the carrier of FIG. 5C showing a harness that may be used to secure riders into carriers.

FIG. 6 shows one embodiment of harness that may be used to harness a rider into a carrier. A rider (not shown) lies on the carrier and is harnessed to the carrier 32 by central harness 60 and leg straps 64. Arm straps (not shown) may be used in addition to central harness 60.

In some embodiments carrier 32 is provided with hand grips (not shown) that a rider can grip during the ride. The hand grips can be formed from any suitable material.

As shown in FIG. 6, leg straps 64 are provided along the legs of a rider. In preferred embodiments the leg straps are around the lower part of the legs of the rider. In one embodiment the position of these straps is adjustable so that riders of different height can be harnessed in the carrier. As well as leg straps 64 further leg straps may be provided to provide more support for the legs, for example additional leg straps could be provided at the knees of a rider.

In the harness of FIG. 6, central harness 60 extends from strap 63 between the legs of a rider to straps 61 over the shoulders of the rider and side straps 62. This arrangement provides full torso support for the rider. Preferably the torso attachment straps 62 are adjustable width-wise to provide for riders of different sizes. In an alternative embodiment additional torso straps (not shown) are provided instead of or in addition to the torso straps 62 of harness 60.

The harness for the carrier securely harnesses the rider to the carrier. In one embodiment the same harness can be used for carriers on all sets of running rails of the ride. In that embodiment, each harness must be suitable for harnessing a rider who may be hanging beneath the carrier or upside down (with all their weight on the harness) for at least part of the ride. In another embodiment different harnesses are provided for different sets of running rails of the ride. Carriers of different lengths and different harnesses may also be provided for riders of different shape, for example a shorter harness and carrier may be provided for child riders. It is preferably that the harness is adjustable to account for riders with different sizes.

It should be noted that FIG. 6 shows only one embodiment of harness and any suitable harness may be used. For example different harnesses will be used with carriers designed for seated riders.

Figure 7:
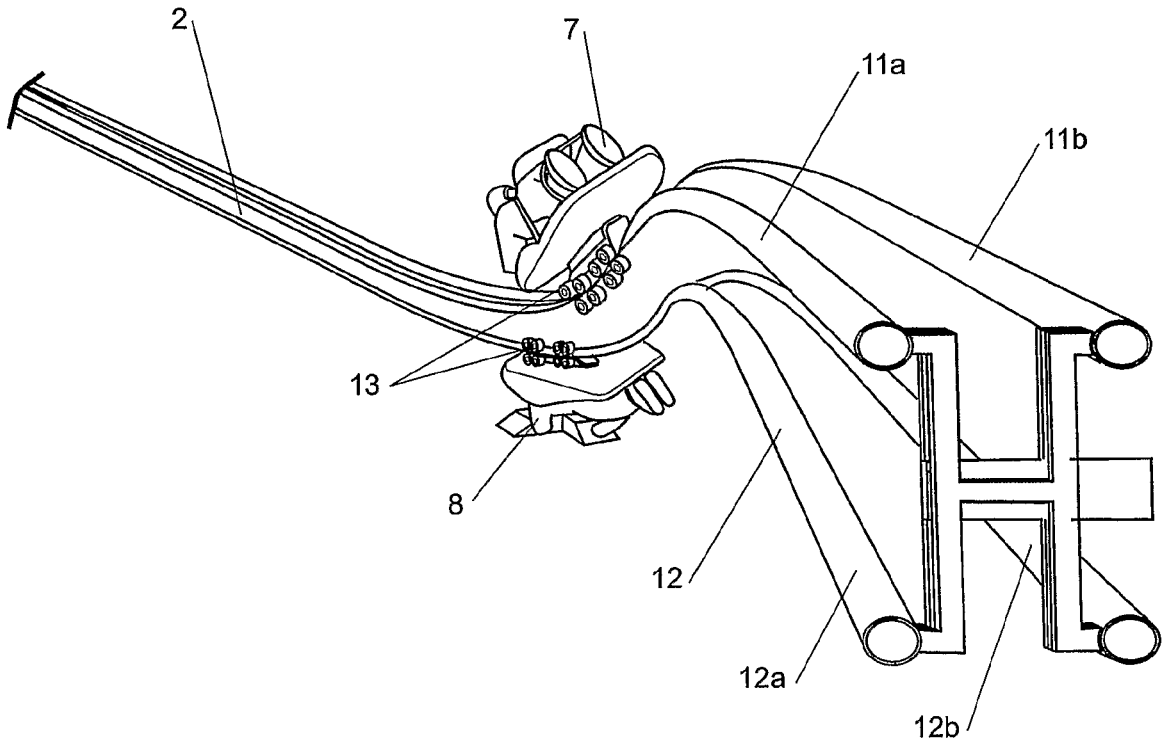
FIG. 7 shows two riders on respective sets of running rails in accordance with a preferred embodiment of the invention.

FIG. 7 is a view of two riders on one embodiment of amusement ride of the invention. Upper rider 7 is in an upper carrier and lower rider 8 is in the lower carrier. In this embodiment both carriers are slidingly engaged with running rails 11A, 11B, 12A and 12B of respective sets of running rails by means of sets of wheels that are arranged around running rails 11A, 11B, 12A and 12B. The running rails in this embodiment are different to those shows in FIGS. 3 and 4. The carriers may also include braking means (not shown) and in some embodiments with means to engage with a lift mechanism to return the carriers to the embark point of the track. As can be seen from this Figure the slope and curve of the track is not uniform. If the track is symmetrical the upper and lower carriers may be identical and interchangeable (in a non-continuous track ride). Alternatively the running rails on each side of the track may be different and the upper and lower carriers may be different.

In FIG. 7, rider 7 is shown in a prone position lying flat on his/her stomach and facing forwards. The carrier could also be arranged so that the rider lies on his/her back and faces forward like a luge ride. Such a position is considered a substantially prone position in the context of this specification, and is shown in FIG. 12.

In FIG. 7, rider 8 is shown lying in a substantially prone position flat on his/her stomach and facing forward. In this Figure the track is depicted so that the set of running rails on the top half of the track is in effect a reflection of the set of running rails on the bottom half of the track and the carriers shown may be utilised by either rider. Other forms of track are possible under the invention and different forms of carrier may be used for riders carried on different running rails of the track.

The foregoing descriptions indicate only two riders slidingly engaged to respective sets of running rails and capable of moving through the same linear point of the ride at the same time. These are indicated as riders engaged to the top and the bottom of the track. It is possible under the invention to extend the number of riders so engaged to three or more by adapting the cross section shape of the track, or to provide separate sets of running rails, to provide for more sets of running rails to allow three or more riders to traverse the track simultaneously. This would increase the capacity of the ride.

Figure 8A:
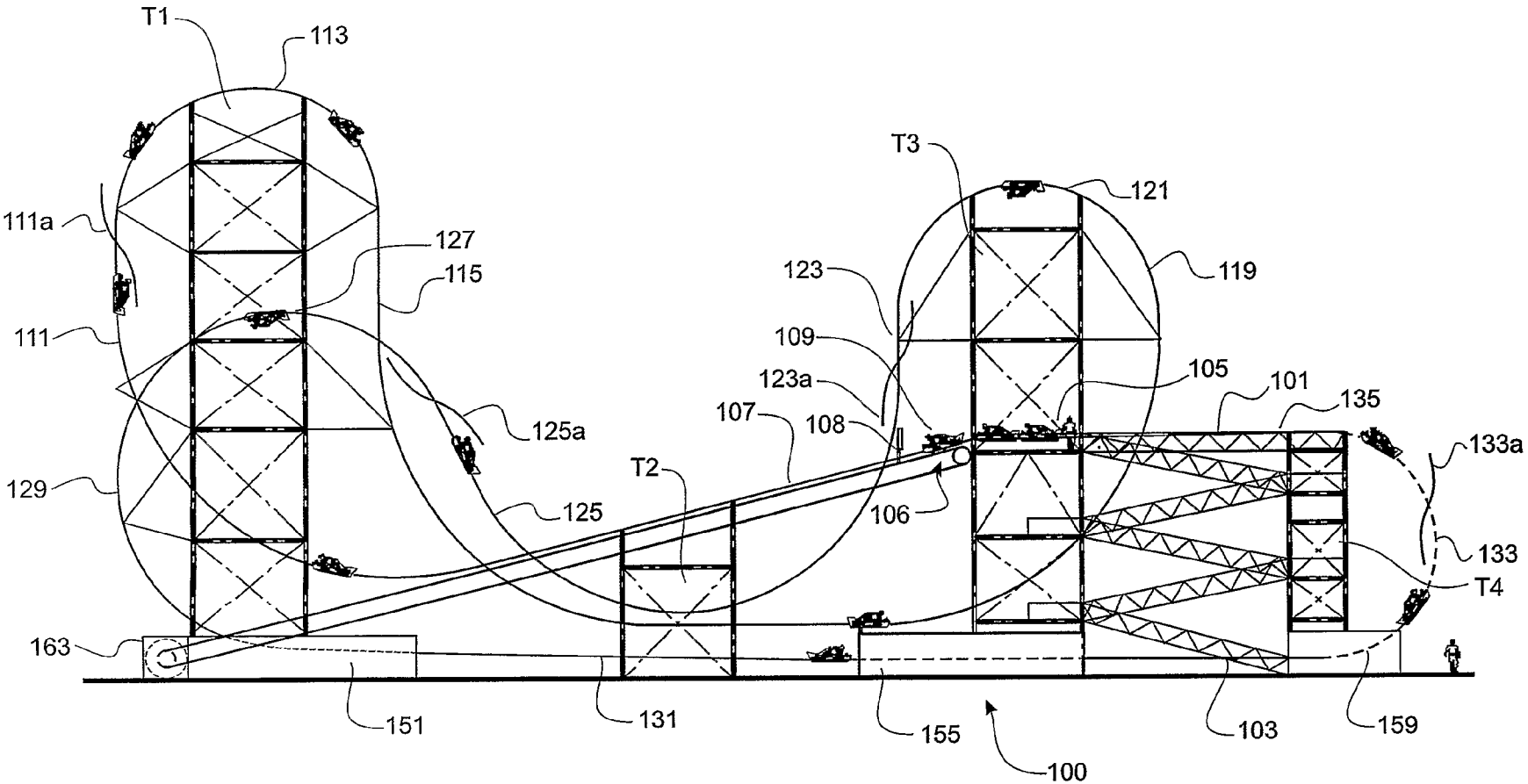
FIG. 8A shows a schematic side view of an amusement ride in accordance with an alternative preferred embodiment of the invention.
Figure 9:
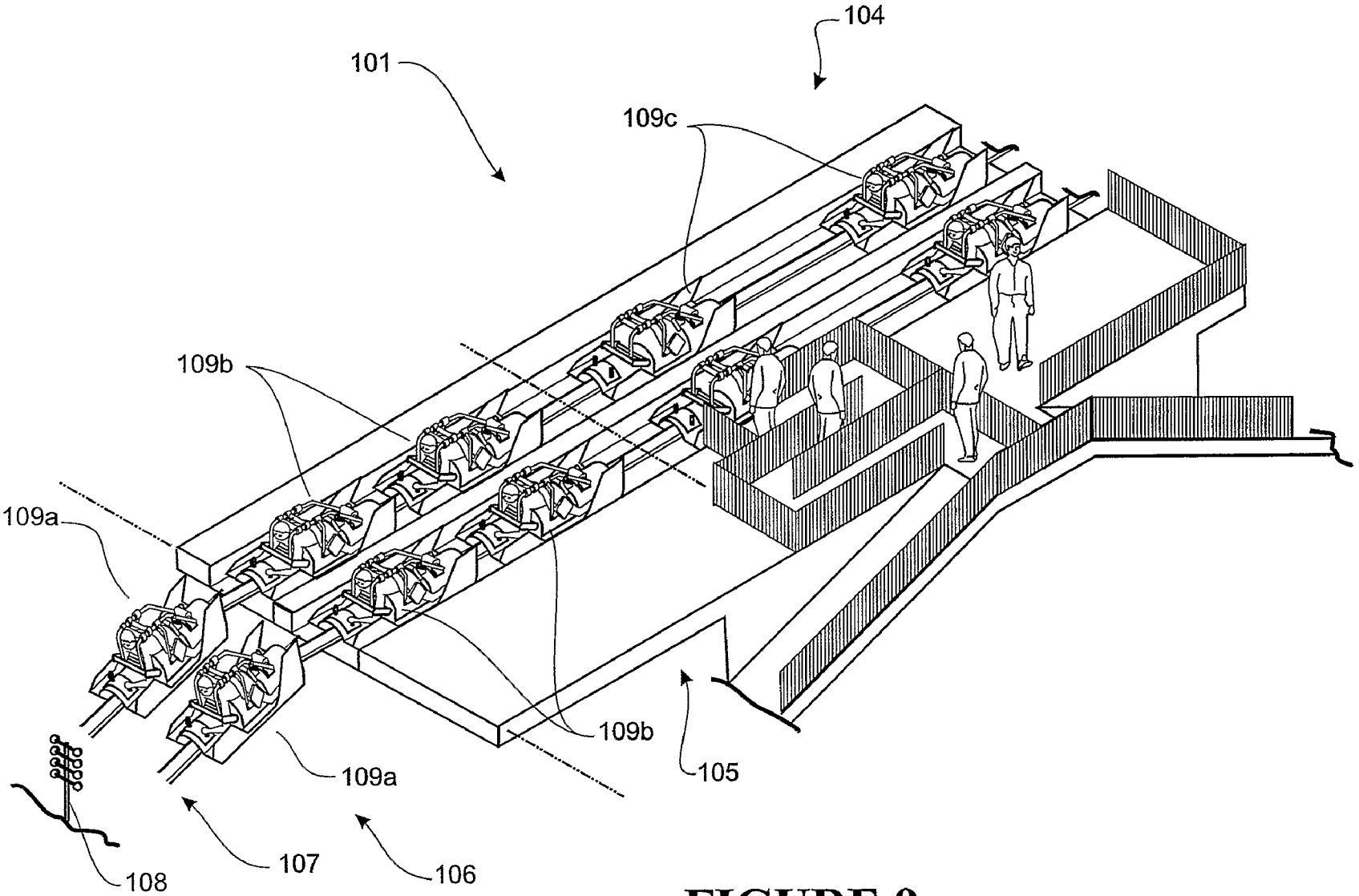
FIG. 9 shows an overhead perspective view of the loading/unloading platform of the amusement ride of FIG. 8.

FIGS. 8A and 8B shows an alternative preferred embodiment drag racing roller coaster amusement ride, indicated generally by reference numeral 100. The ride has two independent sets of running rails, each adapted to carry a respective carrier. Each set of running rails may consist of a single rail or more than one rail. The sets of running rails may be separate for the duration of the ride, forming separate tracks. The ride is provided with an embark point for each set of running rails defined by an unloading and loading platform 101 which is shown in more detail in FIG. 9. Riders can access the unloading and loading platform by climbing a ramp 103. In the region of the unloading and loading platform, the sets of running rails are side-by-side. The sets of running rails in that area also each have a queuing region 105, configured such that as one carrier is traversing the set of running rails, one or more carriers and riders can be queued ready for launch on that set of running rails, to enhance throughput of the ride.

Following each queuing region 105 is a launch ramp 107. The sets of running rails are preferably positioned side-by-side on the launch ramp, to provide an enhanced race start experience. The ride will be provided with a suitable launch system, such as one of those described with reference to FIGS. 14 to 16. At the start of the ride, the carriers 109 will be positioned side-by-side in a launch region 106 at or toward the top of the launch ramp and held in position by any suitable mechanism such as a braking system for example. The carriers will each be provided with a ride activator controllable by a rider of the respective carrier to trigger the launch system to provide a powered initial motion to the carrier, to commence the ride for the respective carrier. The ride will comprise an indicator 108 to provide a ride commencement indication, which may comprise or consist of a visual and/or audible indicator as described above.

The launch system is adapted to power the carriers 109 down the launch ramp, and the carriers then travel through a 3.5 g transition region and climb section 111. As the carriers travel through the transition region, they disconnect from the launch system, so that the launch system can be prepared for the launch of the next carriers. The launch system provides sufficient power for the carriers to climb to a peak 113. If a carrier does not reach the peak 113, a braking system will stop movement of the carrier and the launch system will be deactivated until it is manually reset.

The launch system is preferably configured such that the carriers will each be travelling at the same speed by the time they disconnect from the launch system, irrespective of the weight of the rider(s). It will be appreciated that the carriers may disconnect from the launch system at different times depending on when they are launched by the riders.

After travelling over peak 113, the carriers drop through section 115 under gravity, travel along a generally horizontal section 117, and then climb section 119 to peak 121. The carriers then drop through section 123 under gravity, and climb section 125 to peak 127. The carriers drop through section 129 under gravity, and travel at high speed along generally horizontal section 131. That section 131 is close to ground level, to provide an enhanced sensation of speed for the riders. The carriers then climb section 133 and enter a braking zone 135 in which they are slowed and stopped. Harnesses on the carriers are released, so the riders can exit their carriers. The next riders can then enter the carriers and be queued, ready for their ride. Alternatively, if desired, riders who have just completed a ride can remain in their carriers and be queued ready for their next ride.

Sections of each set of running rails may be provided with rolls or spirals, to make each carrier swap from an inner part of the track to an outer part of the track. Those sections are marked with sinuous lines in FIG. 8A, and are referenced 111*a*, 123*a*, 125*a*, and 133*a*. A number of carriers are shown on the ride, to show the effect of the various rolls or spirals on the movement of the carrier as it transverses the ride.

It will be appreciated that FIGS. 8A and 8B shows a preferred embodiment ride, and the ride or carriers could be of any suitable form and provided with any of the features described above with reference to FIGS. 1 to 7.

FIG. 9 shows the loading/unloading platform and launch region of the ride of FIG. 8. As can be seen, two carriers 109*a* are situated in a launch region 106 on the launch ramp 107 ready to be launched by their respective riders following a ride commencement indication. A plurality of carriers 109*b* are queued in a queuing region 105 behind the launch region, ready to be positioned in the launch region 106 following the launch of the carriers 109*a*. Further carriers 109*c* are shown in a loading/unloading region 104 in which riders can exit the carriers following the end of their ride, and fresh riders can enter the carriers ready to be queued.

In the form shown, the ride is readily relocatable, and is adapted to fit into six 12 m shipping containers and three 6 m shipping containers. The ride can be broken down and reassembled quickly, thus enabling it to be used for events or moved to different venues on a seasonal basis. Four of the 12 m containers 151, 153, 155, 157 are used to form the bases for the two taller towers, T1 and T3. Two of the 6 m containers 159, 161 are used to from the base of tower T4, and could be used to house amenities such as merchandising, office, reception, etc. The third 6 m container 163 can house a launcher drive system, such as that described with reference to FIG. 14, 15, or 16.

The track, towers, ramps, walkways, platforms, and carriers will be sowed on purpose-designed racks that will be able to roll into and out of the containers. Every item can be numbered and have a specific stowing location, to so that the ride can be assembled easily. The ride may be provided with a self-contained power supply such as one or more diesel generators for example.

Figure 10B:
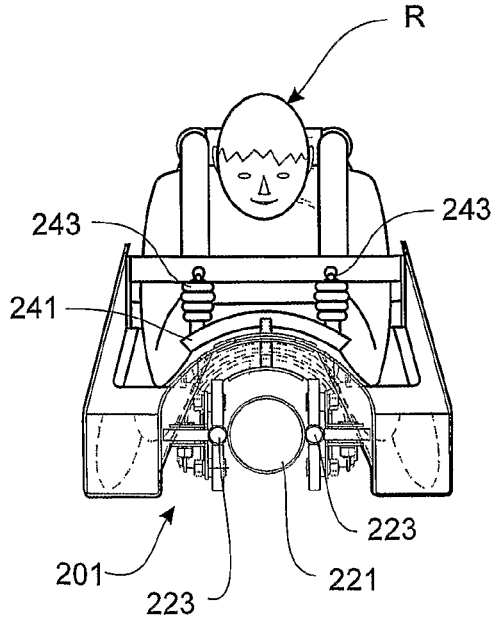
FIG. 10B shows a front view of the carrier of FIG. 10A.

Carriers such as shown in FIG. 1, 2, or 4-7 may be used in the ride of FIG. 8. Alternatively, a carrier such as shown in FIGS. 10 and 11, 12, or 13 may be used. In the form shown in FIGS. 10 and 11, the carrier 201 is sized and adapted to hold a single rider R, in a prone position on his or her front. The carrier 201 is designed to weigh less than about 95 kg, and can support a rider weighing up to about 155 kg. The rider is held in position by a harness 203, which is pivotable about pivot 205 to enable the rider to enter or exit the carrier. The harness has adjustable lateral supports 207, thigh supports 209, shoulder supports 211, and arm supports 213. The carrier also has a rear support 215 to support a user from behind during significant acceleration. In this carrier, the rider R straddles the set of running rails while transversing the ride. In the form shown, the set of running rails comprises a large central member 221 which, in the form shown, is a tube, and two diametrically opposed smaller members 223 which, in the form shown, are also tubes. The members 221, 223 could be substantially solid and any suitable shape. The members 223 define the running rails of the set of running rails. As can be seen in FIG. 10B, the rider R in the carrier straddles the set of running rails 223, so that at least portions of his or her legs are positioned adjacent or below the running rails 223. That provides a particularly low center of gravity of the rider.

The carrier has with two spaced apart wheel assemblies or bogies 236, 237 which are generally similar to those 36, 37 described with reference to FIG. 5. However, this carrier differs in that it includes a mechanism to apply a steering action to the carrier as it traverses the set of running rails. As described above, the ride 100 has a number of rolls or spirals 111*a*, 123*a*, 125*a*, 133*a*, that result in the carrier travelling from the inside of the track to the outside of the track, or vice versa. If each track has a set of running rails configured as shown in FIG. 10, in those zones the smaller rails 223 will spiral around the exterior of the larger member 221. Additionally, the larger member 221 may itself spiral to achieve a "heart-line roll"—which causes the rider to be rotated about an axis that runs approximately through their heart. In either case, the bogies 236, 237 will need to articulate radially about the centerline of the larger member 221 with respect to each other and with respect to the carrier itself. If, for example, the carrier was to invert (180 degree rotation) over a 6 m length of track, the rails would need to rotate 30 degrees per meter. If the wheelbase of the carrier was 1100 mm, the angular displacement of the front bogie relative to the rear bogie would be 33 degrees when both bogies were on a spiraled section of the track.

Figure 11:
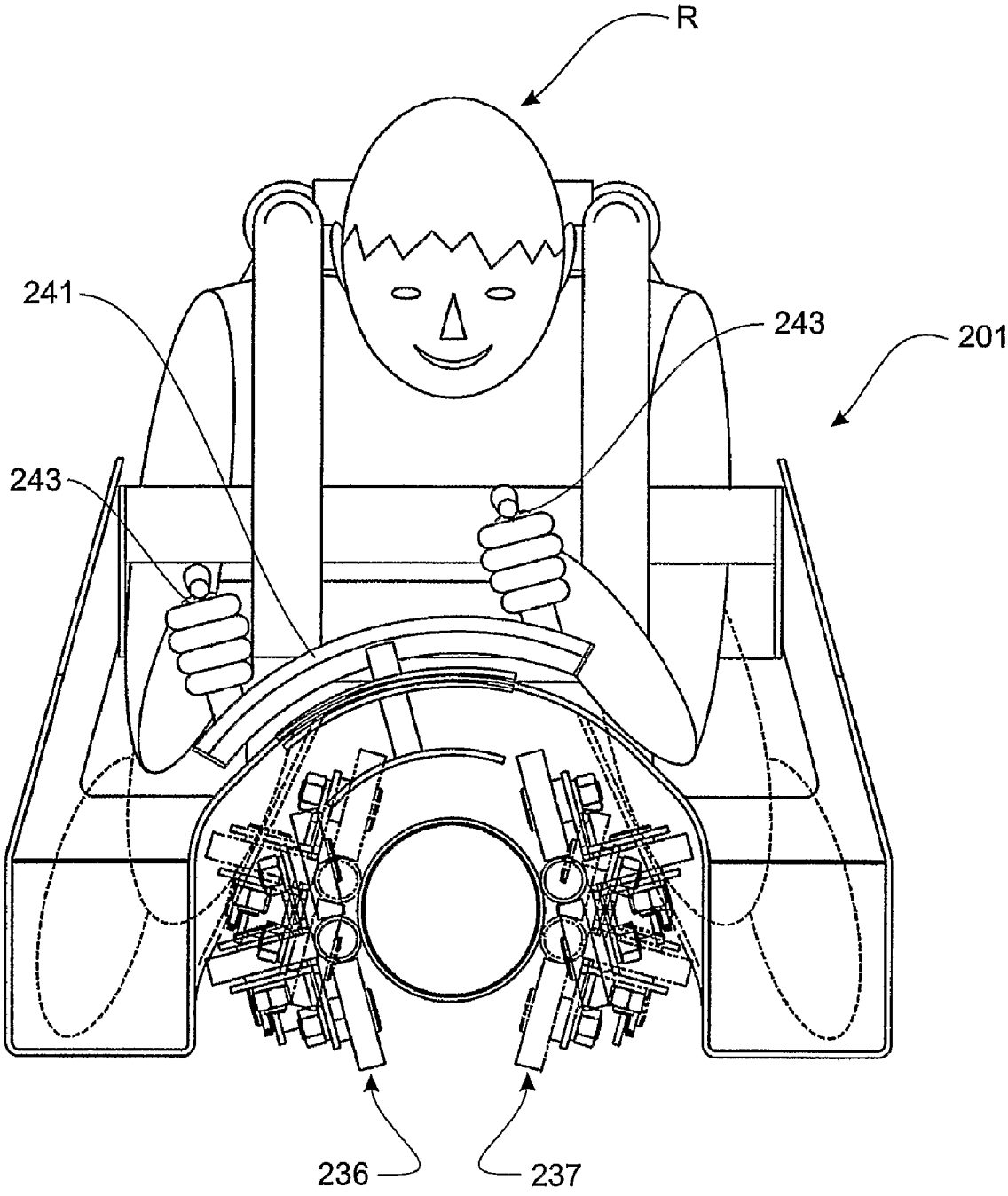
FIG. 11 shows a preferred embodiment mechanism that allows a rider to apply a steering action to the carrier.

The two bogies will be required to articulate in opposite directions relative to the carrier, such as shown in FIG. 11. One mechanism to accommodate the articulation comprises connected hydraulic cylinders (not shown) as radial links between the bogies and the carrier chassis. The hydraulic cylinders will be arranged to rotate the bogies in opposite directions. Rotation of the front bogie relatively to the back bogie, while negotiating a roll, will cause the vehicle chassis to rotate given that it is the only part of the vehicle that is free to rotate. The chassis will rotate half the angular difference between the two bogies. When there is no angular displacement of the bogies, the cylinders will prevent the chassis from rotating with respect to the bogies to enhance the stability of the vehicle.

The angular position of the bogies can be controlled, to at least some extent, by the rider by pivoting the control yoke 241 as shown. While the carrier would be able to negotiate all sections of the track without any rider input, effective steering through use of the yoke 241 results in a mechanical advantage for the carrier by reducing friction or rolling resistance going through the track rolls. This means that the carrier will travel slightly faster through those sections of the track than a carrier which has no steering action applied by a rider, or on which the steering action is applied less effectively. Rather than using a yoke, a wheel, lever, joystick, or other means may be provided for the rider to apply a steering action. In the form shown, the yoke comprises one or more buttons 243 that allow the rider to activate the launch system, or to selectively apply power to the carrier in some embodiments.

Alternatively, or in addition, the mechanism for the rider to apply a steering action may be configured to rotate the bogie about a generally vertical axis (when the carrier is substantially horizontal) to reduce rolling resistance as the carrier traverses a turn on the track.

Figure 12A:
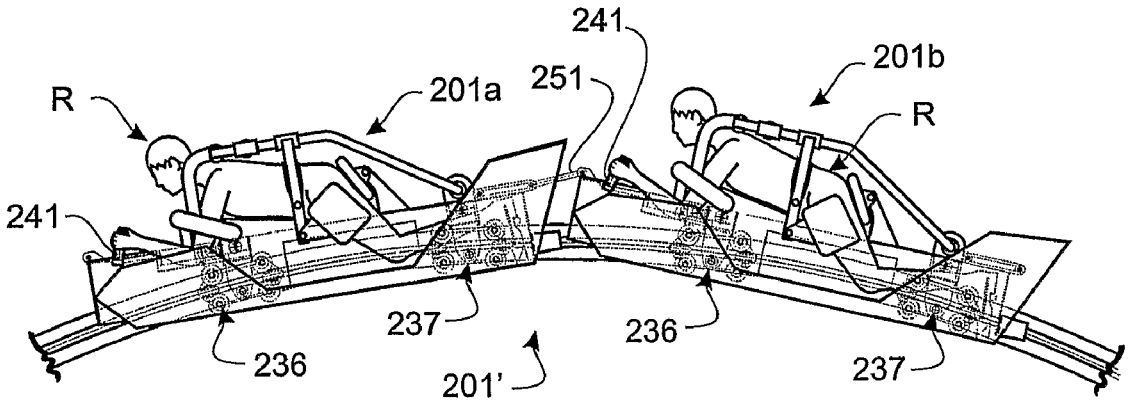
FIG. 12A shows a side view of an alternative preferred embodiment carrier for use in the invention, which carrier is sized and adapted to carry two riders, with the carrier traversing a peak section of a set of running rails.
Figure 12B:
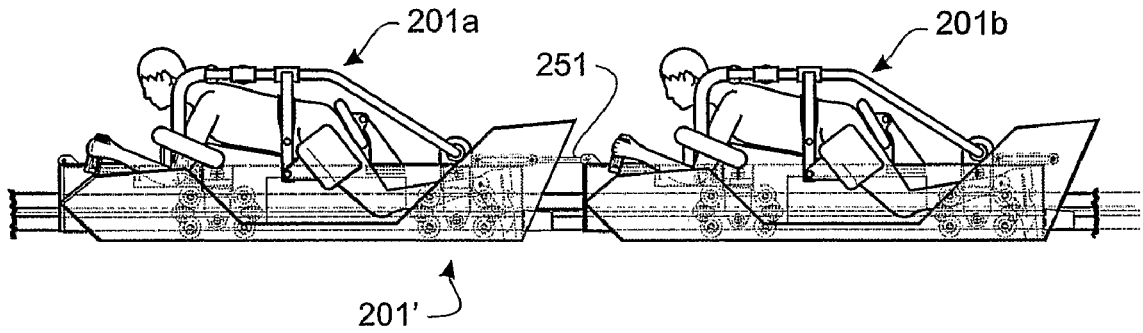
FIG. 12B shows a side view of the carrier of FIG. 12A, with the carrier traversing a generally flat section of a set of running rails.
Figure 12C:
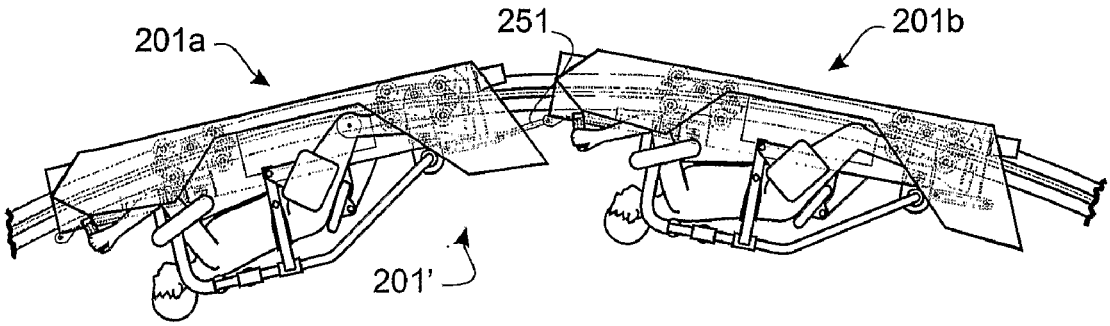
FIG. 12C shows a side view of the carrier of FIG. 12A, with the carrier traversing a peak section of a set of running rails in an inverted orientation.

FIGS. 12A-12C show a carrier 201' that is sized and adapted to carry two riders. This carrier 201' comprises two interconnected carrier units 201*a*, 201*b* that are otherwise the same as that shown in FIGS. 10 and 11. In the form shown, the carriers are interconnected via a connection member or bar 25, which preferably has a ball joint or similar at each end. The carrier will preferably be configured such that both riders need to activate their ride activators to commence the ride for the carrier. Additionally, each carrier unit will suitably be provided with a mechanism 241 for the rider to apply a steering action, such that both riders can apply a steering action to the carrier. The carrier may comprise up to four interconnected carrier units, and each may be provided with a ride activator 243 and a mechanism for applying a steering action 241. Other means of interconnection of the carrier units could be used.

In alternative embodiments, there may be a single carrier unit sized and adapted to carry two, three, or four riders. However, each rider will again preferably be provided with a ride commencement activator and a mechanism for applying a steering action.

Figure 13:
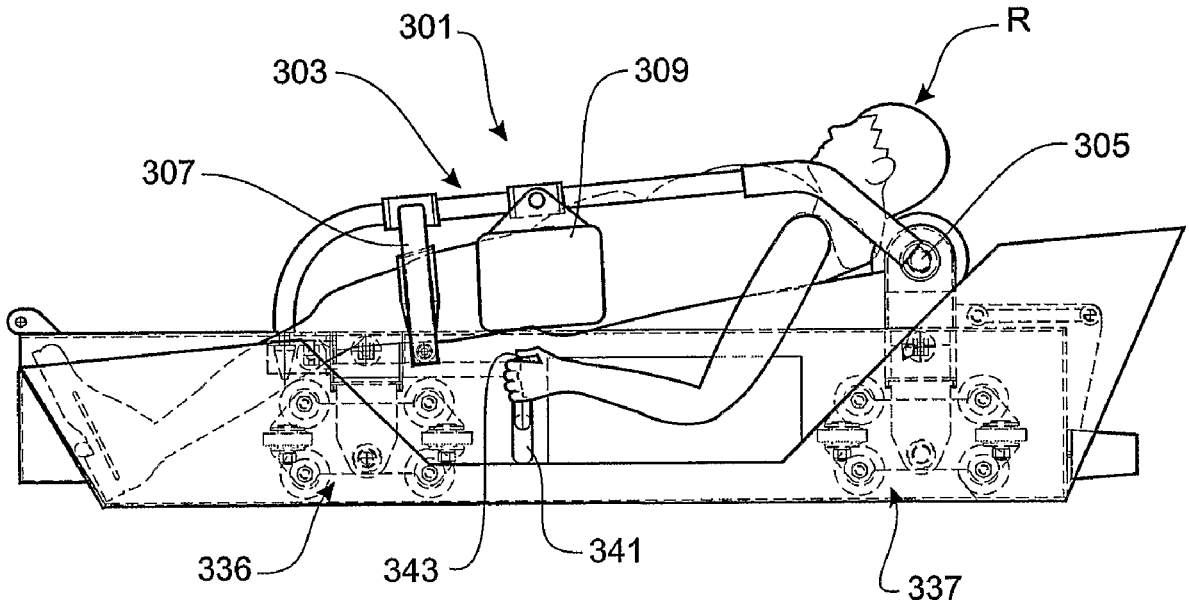
FIG. 13 shows a side view of an alternative preferred embodiment carrier for use in the invention, in which a rider lies in a substantially prone position on his or her back.

FIG. 13 shows an alternative carrier unit 301 in which the rider is held in a substantially prone position on his or her back facing upwards, with his or her feet first in the travelling direction of the carrier. The features and operation should be considered the same as for FIGS. 10A-10C, and like reference numerals are used to indicate like parts, with the addition of 100. In this embodiment, the harness 303 preferably has a support 307 to support each thigh of the rider. The carrier unit could again be interconnected with another carrier unit to form a carrier for carrying more than one person as described above with reference to FIG. 12.

The preferred embodiment amusement rides described above enable riders to commence their rides at the same time and race each other to the conclusion of the ride.

Launch Systems

Each of the following described preferred embodiment launch systems uses a flywheel to store energy that is then selectively transferred to each of two or more carriers to independently launch the carriers. Each of the launch systems can be used with carriers in which the rider(s) are in substantially prone position(s), or alternatively with carriers having rider(s) in different positions. The carriers may hold any suitable number of riders.

FIG. 14 shows a schematic diagram of a first preferred embodiment launch system for launching the carriers of the preferred embodiment rides described above, or indeed for launching carriers in other amusement rides. As described above, the carriers 1001*a*, 1001*b* are suitably mounted on respective sets of running rails 1002*a*, 1002*b*, each of which may consist of one or more running rails.

The launch system comprises a flywheel 1005 adapted to store energy and an energy source 1007 to rotate the flywheel. The energy source may be an internal combustion motor, diesel generator, electric motor, or any other suitable energy source. In the form shown, the energy source drives the flywheel via a rotatable member 1007*a* such as a tyre drive. Two selective energy transfer mechanisms 1009*a*, 1009*b* are operatively connected to the flywheel 1005, such as via the flywheel shaft 1005*a* as shown. One or more transmissions or gearboxes could be provided between the flywheel and the selective energy transfer mechanisms to enable the flywheel to spin at a greater speed. One selective energy transfer mechanism is associated with each carrier. Accordingly, three or more selective energy transfer mechanisms could be used for three or more carriers.

Each selective energy transfer mechanism is operatively connected to a respective carrier launch mechanism 1011*a*, 1011*b*. Each carrier launch mechanism has a pulley or drive sheave 1013*a*, 1013*b* to which a cable 1015*a*, 1015*b* is operatively connected. The cable may be an endless cable as shown, in which case the cable extends around a tail pulley or sheave 1017*a*, 1017*b*. An engagement mechanism in the form of a trolley 1019*a*, 1019*b* is attached to each cable, and is configured to run on a respective trolley track 1021*a*, 1021*b*. Each trolley has a pivotally mounted pusher member 1023*a*, 1023*b* which is adapted to engage the carrier to launch the carrier, but which can move toward the trolley base to clear the next carrier as the trolley is being moved back to a launch position prior to launching the next carrier. Each selective energy transfer mechanism is operatively connected to a respective pulley 1013*a*, 1013*b*.

In use, the flywheel will be spinning as a result of energy transferred from the energy source 1007. With the selective energy transfer mechanisms disengaged, no torque is transferred to the carrier launch mechanisms, and the carriers are stationary in the position shown (generally side-by-side). When the selective energy transfer mechanisms are engaged, torque is transferred via the selective energy transfer mechanisms to the pulleys 1013*a*, 1013*b* respective carrier launch mechanisms, which causes the trolleys and thereby the carriers to rapidly accelerate down the sets of running rails. The carriers then disconnect from the trolleys, and continue traversing the ride as a result of the force applied thereto by the trolleys. The trolleys can then be returned to the launch position shown in FIG. 14, ready to launch the next carriers.

Each selective energy transfer mechanism is adapted to transfer energy to the respective carrier, independently of any other carriers. The selective energy transfer mechanisms may be engaged by the riders of the carriers. When a rider one a carrier activates their ride activator, that will signal a control system via radio frequency transmission for example, to engage the selective energy transfer mechanism for that carrier. Alternatively, the selective energy transfer mechanisms may be configured to be activated by a ride operator who is not riding in the carriers.

The above described components and operation of the launch systems will typically be the same for each of the launch systems described with reference to FIGS. 14, 15, and 16.

In the form shown in FIG. 14, each selective energy transfer mechanism comprises a mechanical clutch. The clutches 1009*a*, 1009*b* shown in FIG. 14 are hydraulically actuated fluid clutches. When hydraulic fluid is pressurised, the clutch will be engaged such that torque is transmitted from the flywheel to the respective carrier, via the clutch. Appendix A lists the other components of the system shown in FIG. 14, and the operation thereof will be apparent to a skilled person.

The launch system is controlled via a control system. The control system may be adapted to electronically manage the rate of engagement of at least one of the selective energy transfer mechanisms, to adjust the speed and/or force of the launch of an associated carrier in order to compensate for rider(s) of uneven weight or differing skill levels. It is preferred that the control system is adapted such that both carriers are travelling at substantially the same speed when they reach the point of separation from the launch ramp, irrespective of the weight of the rider(s). It will be appreciated that the carriers may reach the point of separation from the launch ramp at different times, depending on when they are launched by the respective rider(s). The control system may function in response to sensors that measure the carriers' position, speed, or acceleration for example. In the embodiment of FIG. 13, the control system manages the rate of clutch engagement by varying hydraulic fluid pressure applied to one or both of the clutches.

The clutches could be actuated with other means such as compressed air or water. The clutches could instead be electromechanical clutches or other types of mechanical clutches.

In rides having default start mechanisms, the control system may be adapted to engage the clutches automatically after a predetermined time delay.

FIG. 15 shows an alternative preferred embodiment launch system. Unless described below, the features and operation should be considered the same as for FIG. 14, and like reference numerals are used to indicate like parts with the addition of 1000.

Instead of using mechanical clutches, this system uses epicyclic gearboxes as the selective energy transfer means 2009*a*, 2009*b*. In this configuration, one part of the gearbox, and most preferably the annulus, is operatively connected to the flywheel 2005. Another part of the gearbox, preferably the planet gears, is operatively connected to the drive sheave or pulley 2013*a*, 2013*b* of the respective carrier launch mechanism. The remaining part of the gearbox, namely the sun gear, is operatively connected to or fitted with a brake mechanism 2020*a*, 2020*b*, such as a drum brake, disk brake, or band brake for example. To launch the respective carrier, the brake mechanism 2020*a* or 2020*b* starts to engage, which will cause the associated section of the gearbox to slow and the section operatively connected to the pulley 2013*a*, 2013*b* would accordingly speed up to apply torque to the pulley and launch the carrier. The brake actuating pressure can be adjusted by a control system as outlined above to adjust the launch parameters to compensate for riders of uneven weight for example, such that both carriers are travelling at substantially the same speed when they reach the point of separation from the launch ramp as outlined above. It will be appreciated by a skilled person that the various parts of the gearbox can be operatively connected to different items of the launch system. Appendix A also lists the other components of the system shown in FIG. 15, and the operation thereof will be apparent to a skilled person.

FIG. 16 shows an alternative preferred embodiment launch system. Unless described below, the features and operation should be considered the same as for FIG. 14, and like reference numerals are used to indicate like parts with the addition of 2000. In this embodiment, each of the selective energy transfer mechanisms comprises a hydraulic motor 3009*a*, 3009*b*, such as a bidirectional radial piston motor.

The flywheel 3005 is spun by a suitable energy source which, in the form shown is a rotatable member 3007*a* driven by a fixed displacement hydraulic motor 3007. The motor is supplied hydraulic fluid by a variable placement axial piston hydraulic pump 1007*b* which, in turn, is driven by an electric motor 1007*c*. The fixed displacement hydraulic motor can operate to keep the flywheel at an optimal speed during launch of the carriers.

Each hydraulic motor 3009*a*, 3009*b* is arranged in a closed loop with a variable displacement axial piston pump 3009*c*, 3009*d*. The pumps 3009*c*, 3009*d* are operatively connected to the flywheel, and in the form shown via respective epicyclic gearboxes 3009*e*, 3009*f*. The gearboxes enable the pumps 3009*c*, 3009*d* to spin significantly faster than the flywheel. The displacement and delivery pressure of the pumps 3009*c*, 3009*d* are electronically controlled to provide an increasing flow of fluid to the motors 3009*a*, 3009*b*. As the motors have fixed displacement, they will spin faster as they receive more oil from the pump. As a motor 3009*a*, 3009*b* spins faster, so does the respective sheave or pulley 3013*a*, 3013*b* thus accelerating the launching trolley.

The acceleration profile of either carrier is readily adjusted by changing the pump displacement profile via the controller. If there is a difference in rider weight, the controller may cause one pump to deliver more pressure to the hydraulic motor launching the heavier person, such that both carriers are travelling at substantially the same speed when they reach the point of separation from the launch ramp as outlined above.

At the end of the launch when the cart and rider have been dispatched along the track, the launching trolley 3019*a*, 3019*b* will be brought to a halt by ramping back the displacement on the pump 3009*c*, 3009*d*. This will have the effect of slowing the motor 3009*a*, 3009*b*, and the energy absorbed by the motor will be delivered back to the flywheel via the pump.

When the launching trolley has stopped the pump can be run in reverse and the trolley pulled back to the top of the launch track.

A counterweight 3018*a*, 3018*b*, applied to the tail sheave 3017*a*, 3017*b*, can be used to maintain a suitable tension on the launching cable 3015*a*, 3015*b*.

Pressure relief valves 3022*a*, 3022*b* are used to protect the system from overpressure caused by thermal expansion of the fluid or malfunction of the pumps 3009*c*, 3009*d*, or motors 3009*a*, 3009*b*. Suction line filters 3024*a*, 3024*b* protect the pumps and motors from damage due to the ingress of dirt or foreign bodies.

Ancillary pumps 3025*a*, 3025*b* are used to prime the closed circuit and can also be used to jog, or position, the launching trolley at times when the flywheel is not running, say during maintenance procedures. These pumps may be controlled via respective electric motors 3026*a*, 3026*b*. Directional control valves 3027*a*, 3027*b* are used to allow the trolley to be jogged in both directions.

Speed sensors such as rotary encoders 3028*a*, 3028*b*, and 3028*c* are used to monitor the speed of the flywheel and the speed and position of the launching trolley. Proximity switches may be provided to measure the positions of the carriers if desired. The system is also provided with a fluid reservoir 3029, and a check valve 3031.

The foregoing describes preferred forms of the invention, and alterations and modifications may be made thereto without departing from the scope of the accompanying claims.

APPENDIX A

Other FIGS. 14 and 15 components and their functions

| Item | Description | Function |
|---|---|---|
| 1007b, 2007b | Variable fill fluid coupling | Accommodates flywheel inertia |
| 2020c, 2020d | Sun gear brake | Stops drive system after launch |
| 1029, 2029 | Hydraulic fluid reservoir | Provides fluid buffer |
| 1031, 2031 | Speed sensor | Measures flywheel speed |
| 1031a, 1031b, 2031a, 2031b | Gear pump | Activates the clutch 1009a, 1009b |
| 1033a, 1033b, 2033a, 2033b | Proportional flow control valve | Controls clutch pressure |
| 1034a, 1034b, 2034a, 2034b | Proportional flow control valve | Controls brake pressure |
| 1035a, 1035b, 2035a, 2035b | Pressure relief valve | Protects against over-pressure |
| 1036, 2036 | Suction line filter | Cleans hydraulic fluid |
| 1037a, 1037b, 2037a, 2037b | Speed sensor | Measures trolley/ carrier position/ speed |
| 1038a, 1038b, 2038a, 2038b | Launcher reset motor | Returns carrier to launch position |

-continued

| Item | Description | Function |
|---|---|---|
| 1039a, 1039b, 2039a, 2039b | Launcher reset gearbox | Returns carrier to launch position |
| 1040a, 1040b, 2040a, 2040b | Launcher reset clutch | Disengages return drive during launch |
| 2041a, 2041b | Proximity switch | Confirms carrier location |

The invention claimed is:

1. A drag racing roller coaster amusement ride comprising:

at least two sets of independent running rails, wherein each set has at least one running rail and an embark point;

at least two carriers each arranged to carry at least one rider on a respective set of running rails with the rider(s) in a substantially prone position, each carrier comprising at least one attachment mechanism arranged to slidingly engage with the respective set of running rails to enable the carriers to traverse the ride carrying the riders;

an indicator arranged to provide a ride commencement indication;

a launch system configured to provide a powered initial motion to each carrier;

and a ride activator for each carrier controllable by a rider of the respective carrier to trigger the launch system to commence the ride for the respective carrier following the ride commencement indication;

wherein the sets of running rails are arranged so that the carriers descend at least part of the ride, after the initial powered motion from the launch system, under gravity, and wherein at least one of the carriers comprises a mechanism for at least one rider to apply a steering action to the carrier as it traverses the respective set of running rails, the mechanism adapted such that effective steering results in a mechanical advantage for the carrier by reducing friction between the carrier and the set of running rails as the carrier traverses regions of the respective set of running rails.

2. A drag racing roller coaster amusement ride as claimed in claim 1, wherein at least one of the sets of running rails consists of a single rail.

3. A drag racing roller coaster amusement ride as claimed in claim 1 wherein at least one of the sets of running rails consists of two rails.

4. A drag racing roller coaster amusement ride as claimed in claim 1, wherein each set of running rails is part of a respective track, and the tracks are independent from one another.

5. A drag racing roller coaster amusement ride as claimed in claim 1, wherein forward motion of each carrier on the respective set of running rails is unpowered, other than by the launch system at the commencement of the ride.

6. A drag racing roller coaster amusement ride as claimed in claim 1, wherein forward motion of each carrier on the respective set of running rails is powered for only part of the ride, other than at the commencement of the ride.

7. A drag racing roller coaster amusement ride as claimed in claim 6, wherein the carriers are configured such that a rider can selectively apply the power at one or more sections of the ride.

8. A drag racing roller coaster amusement ride as claimed in claim 1, further comprising an anti-false start mechanism for each carrier that is configured to prevent a rider from launching the respective carrier prior to the ride commencement indication.

9. A drag racing roller coaster amusement ride as claimed in claim 1, further comprising a default start mechanism that is configured to launch the respective carrier after a predetermined period following the ride commencement indication if a rider fails to trigger the launch system.

10. A drag racing roller coaster amusement ride as claimed in claim 1, wherein each carrier is configured to support the rider(s) suspended below the respective set of running rails.

11. A drag racing roller coaster amusement ride as claimed in claim 1, wherein each carrier is configured to support the rider(s) above the respective set of running rails.

12. A drag racing roller coaster amusement ride as claimed in claim 1, wherein each carrier is configured to support the rider(s) either above or below the respective set of running rails.

13. A drag racing roller coaster amusement ride as claimed in claim 1, wherein the indicator comprises or consists of a visual indicator.

14. A drag racing roller coaster amusement ride as claimed in claim 1, wherein the indicator comprises of consists of an audible indicator.

15. A drag racing roller coaster amusement ride as claimed in claim 1, wherein the sets of running rails, although being of substantially the same length, are configured to diverge and then converge to create the impression of one carrier falling behind another and then catching up, and vice versa.

16. A drag racing roller coaster amusement ride as claimed in claim 1, wherein the sets of running rails are configured with one or more of the group consisting of: twists, turns, barrel rolls, loops, and inversions.

17. A drag racing roller coaster amusement ride as claimed in claim 1, wherein a carrier can be returned to an initial launch position without re-traversing any part of the set of running rails traversed during the ride.

18. A drag racing roller coaster amusement ride as claimed in claim 17, wherein each set of running rails is formed as a closed loop.

19. A drag racing roller coaster amusement ride as claimed in claim 17, wherein each set of running rails is formed as an open loop, and the carriers are detachable from the respective set of running rails and re-attachable for a subsequent ride.

20. A drag racing roller coaster amusement ride as claimed in claim 17, wherein each set of running rails is formed as an open loop, but a portion of each set of running rails at or near an end of the ride is moveable to carry the carrier to a portion of the set of running rails at or near the embark point.

21. A drag racing roller coaster amusement ride as claimed in claim 17, wherein each set of running rails has a queuing region configured such that as one carrier is traversing a set of running rails, one or more carriers and riders can be queued ready for launch on that set of running rails.

22. A drag racing roller coaster amusement ride as claimed in claim 1, wherein said at least one of the carriers is sized and adapted to carry multiple riders, and wherein the carrier comprises a mechanism for each of the riders to apply a steering action to the carrier as it traverses regions of the respective set of running rails.

23. A drag racing roller coaster amusement ride as claimed in claim 1, wherein at least one of the carriers is sized and adapted to carry a maximum of four riders, each in a substantially prone position.

24. A drag racing roller coaster amusement ride as claimed in claim 23, wherein said at least one of the carriers has an unloaded weight of less than about 500 kg.

25. A drag racing roller coaster amusement ride as claimed in claim 1, wherein at least one of the carriers is sized and adapted to carry a single rider.

26. A drag racing roller coaster amusement ride as claimed in claim 25, wherein said at least one of the carriers has an unloaded weight of less than about 300 kg.

27. A drag racing roller coaster amusement ride as claimed in claim 1, wherein at least one of the carriers is adapted to carry a minimum of one rider and a maximum of two riders.

28. A drag racing roller coaster amusement ride as claimed in claim 27, wherein said at least one of the carriers has an unloaded weight of less than about 450 kg.

29. A drag racing roller coaster amusement ride as claimed in claim 1, wherein at least one of the carriers is sized and adapted to carry multiple riders, and wherein each of the riders of that carrier must activate a ride activator to trigger the launch system to commence the ride for that carrier.

30. A drag racing roller coaster amusement ride as claimed in claim 1, wherein at least one of the carriers is configured such that at least one of the riders of that carrier straddles the respective set of running rails, to provide a low center of gravity for the rider(s).

31. A drag racing roller coaster amusement ride as claimed in claim 1, wherein the launch system comprises a flywheel adapted to store energy, an energy source to rotate the flywheel, and two selective energy transfer mechanisms operatively connected to the flywheel, wherein each of the selective energy transfer mechanisms is operable, in response to actuation of a ride activator of a respective carrier, to independently transfer energy from the flywheel to the respective carrier to launch the respective carrier along the respective set of running rails.

32. A drag racing roller coaster amusement ride as claimed in claim 31, wherein at least one of the selective energy transfer mechanisms comprises a mechanical clutch.

33. A drag racing roller coaster amusement ride as claimed in claim 31, wherein at least one of the selective energy transfer mechanisms comprises an epicyclic gearbox.

34. A drag racing roller coaster amusement ride as claimed in claim 31, wherein at least one of the selective energy transfer mechanisms comprises a hydraulic motor.

35. A drag racing roller coaster amusement ride, comprising:

at least two sets of independent running rails, wherein each set has at least one running rail and an embark point;

at least two carriers each arranged to carry at least one rider on a respective set of running rails, each carrier comprising at least one attachment mechanism arranged to slidingly engage with the respective set of miming rails to enable the carriers to traverse the ride carrying the riders;

an indicator arranged to provide a ride commencement indication;

a launch system configured to provide a powered initial motion to each carrier;

and a ride activator for each carrier controllable by a rider of the respective carrier to trigger the launch system to commence the ride for the respective carrier following the ride commencement indication;

wherein the sets of running rails are configured such that a respective carrier can be returned to an initial launch position without re-traversing any part of the set of running rails traversed during the ride, and each set of running rails has a queuing region configured such that as one carrier is traversing a set of running rails, one or more carriers and riders can be queued ready for launch on that set of running rails, and wherein the sets of running rails are arranged so that the carriers descend at least part of the ride, after the initial powered motion from the launch system, under gravity, and wherein at least one of the carriers comprises a mechanism for at least one rider to apply a steering action to the carrier as it traverses the respective set of running rails, the mechanism adapted such that effective steering results in a mechanical advantage for the carrier by reducing friction between the carrier and the set of running rails as the carrier traverses regions of the respective set of running rails.

36. A drag racing roller coaster amusement ride as claimed in claim 35, wherein each set of running rails is formed as a closed loop.

37. A drag racing roller coaster amusement ride as claimed in claim 35, wherein each set of running rails is formed as an open loop, and the carriers are detachable from the respective set of running rails and re-attachable for a subsequent ride.

38. A drag racing roller coaster amusement ride as claimed in claim 35, wherein each set of running rails is formed as an open loop, but a portion of each set of running rails at or near an end of the ride is moveable to carry the carrier to a portion of the set of running rails at or near the embark point.

39. A drag racing roller coaster amusement ride as claimed in claim 36, wherein at least one of the sets of running rails consists of a single rail.

40. A drag racing roller coaster amusement ride as claimed in claim 35, wherein at least one of the sets of running rails consists of two rails.

41. A drag racing roller coaster amusement ride as claimed in claim 35, wherein each set of running rails is part of a respective track, and wherein the tracks are independent from one another.

42. A drag racing roller coaster amusement ride as claimed in claim 35, wherein forward motion of each carrier on the respective set of running rails is unpowered, other than by the launch system at the commencement of the ride.

43. A drag racing roller coaster amusement ride as claimed in claim 35, wherein forward motion of each carrier on the respective set of running rails is powered for only part of the ride, other than at the commencement of the ride.

44. A drag racing roller coaster amusement ride as claimed in claim 43, wherein the carriers are configured such that a rider can selectively apply the power at one or more sections of the ride.

45. A drag racing roller coaster amusement ride as claimed in claim 35, further comprising an anti-false start mechanism for each carrier that is configured to prevent a rider from launching the respective carrier prior to the ride commencement indication.

46. A drag racing roller coaster amusement ride as claimed in claim 35, further comprising a default start mechanism that is configured to launch the respective carrier after a predetermined period following the ride commencement indication if a rider fails to trigger the launch system.

47. A drag racing roller coaster amusement ride as claimed in claim 35, wherein the indicator comprises or consists of a visual indicator.

48. A drag racing roller coaster amusement ride as claimed in claim 35, wherein the indicator comprises or consists of an audible indicator.

49. A drag racing roller coaster amusement ride as claimed in claim 35, wherein the sets of running rails, although being of substantially the same length, are configured to diverge and then converge to create the impression of one carrier falling behind another and then catching up, and vice versa.

50. A drag racing roller coaster amusement ride as claimed in claim 35, wherein the sets of running rails are configured with one or more of the group consisting of: twists, turns, barrel rolls, loops, and inversions.

51. A drag racing roller coaster amusement ride as claimed in claim 35, wherein said at least one of the carriers is sized and adapted to carry multiple riders, and wherein the carrier comprises a mechanism for each of the riders to apply a steering action to the carrier as it traverses regions of the respective set of running rails.

52. A drag racing roller coaster amusement ride as claimed in claim 35, wherein at least one of the carriers is sized and adapted to carry multiple riders, and wherein each of the riders of that carrier must activate a ride activator to trigger the launch system to commence the ride for that carrier.

53. A drag racing roller coaster amusement ride as claimed in claim 35, wherein the launch system comprises a flywheel adapted to store energy, an energy source to spin the flywheel, and two selective energy transfer mechanisms operatively connected to the flywheel, wherein each of the selective energy transfer mechanisms is operable, in response to actuation of a ride activator of a respective carrier, to independently transfer energy from the flywheel to the respective carrier to launch the respective carrier along the respective set of running rails.

54. A drag racing roller coaster amusement ride as claimed in claim 53, wherein at least one of the selective energy transfer mechanisms comprises a mechanical clutch.

55. A drag racing roller coaster amusement ride as claimed claim 53, wherein at least one of the selective energy transfer mechanisms comprises an epicyclic gearbox.

56. A drag racing roller coaster amusement ride as claimed in claim 53, wherein at least one of the selective energy transfer mechanisms comprises a hydraulic motor.

* * * * *